US006024776A

United States Patent [19]

Heinrich et al.

[11] Patent Number: 6,024,776

[45] Date of Patent: Feb. 15, 2000

[54] CERMET HAVING A BINDER WITH IMPROVED PLASTICITY

[75] Inventors: Hans-Wilm Heinrich; Manfred Wolf; Dieter Schmidt, all of Bayreuth, Germany; Uwe Schleinkofer, Latrobe, Pa.

[73] Assignee: Kennametal Inc., Latrobe, Pa.

[21] Appl. No.: 08/918,993

[22] Filed: Aug. 27, 1997

[51] Int. Cl.[7] ..... C22C 29/04

[52] U.S. Cl. ..... 75/238; 75/236; 75/242; 419/15; 419/16; 419/48

[58] Field of Search ..... 75/236, 238, 242, 75/244; 419/13, 15, 16, 18, 48

[56] References Cited

U.S. PATENT DOCUMENTS

| | | | |
|---|---|---|---|
| Re. 34,180 | 2/1993 | Nemeth et al. | 428/547 |
| 2,162,574 | 6/1939 | Dawihl et al. . | |
| 2,202,821 | 6/1940 | Balke . | |
| 3,514,271 | 5/1970 | Yates | 29/182.5 |
| 3,816,081 | 6/1974 | Hale . | |
| 4,049,380 | 9/1977 | Yih et al. | 428/539.5 |
| 4,556,424 | 12/1985 | Viswanadham | 75/240 |
| 4,642,003 | 2/1987 | Yoshimura | 408/144 |
| 4,743,515 | 5/1988 | Fisher et al. | 428/698 |
| 5,541,006 | 7/1996 | Conley | 428/552 |
| 5,658,395 | 8/1997 | Wahlberg et al. | 148/237 |
| 5,821,441 | 10/1998 | Kawamura | 75/248 |

FOREIGN PATENT DOCUMENTS

| | | |
|---|---|---|
| 1543214 | 10/1968 | France . |
| 29617040 | 3/1997 | Germany . |
| 2273301 | 6/1994 | United Kingdom . |
| WO9621052 | 7/1996 | WIPO . |
| 9721844A | 6/1997 | WIPO . |

OTHER PUBLICATIONS

L.J. Prakash et al.: "The Influence of the Binder Composition on the Properties of WC–Fe/Co/Ni Cemented Carbides," Mod. Dev. Powder Metal, vol. 14, 1981, XP002085832.

Chemical Abstracts, vol. 121, No. 22, Nov. 1994, Abstract No. 261210. (J.M. Guilemany et al.: "Mechanical–Property Relationships of Co/WC and Co–Ni–Fe/WC Hard Metal Alloys," Int. J. Refractory Metals & Hard Materials, (1994), 12(4), 199–206).

B. Uhrenius et al.: "On the Composition of Fe–Ni–Co–WC–based Cemented Carbides," vol. 15, 1997, pp. 139–149, XP002085833.

H. Grewe et al.: "Subsitution of Cobalt in Cemented Carbides," Metall (Berlin) (1986), 40(2), 133–40, XP002086162.

Chemical Abstracts, vol. 126, No. 9, Mar. 1997, Abstract No. 121055. (Yoshihiro Minato et al.: "Tungsten Carbide–Based Hard Alloys Having High Impact Resistance for Tools," JP 08 302441 A (Sumitomo Electric Industries, Japan)).

Chemical Abstracts, vol. 114, No. 6, Feb. 1991, Abstract No. 47911. (Noribumi Kikichi et al.: "Manufacture of Surface–Coated Tungsten Carbide–Based Cermets for Cutting Tools," JP02 022454 (Mitsubishi Metal Corp., Japan)).

Chemical Abstracts, vol. 108, No. 12, Mar. 1988, Abstract No. 99568. (Sokichi Taktau et al.: "Alumina–Coated (Mitsubishi Metal Corp., Japan) Sintered Alloys for Cutting Tools," JP 62 047123 (Toshiba Tungaloy Co., LTD, Japan)).

Copies of International Search Reports mailed Dec. 14, 1998, in Application Nos. PCT/IB98/01297, PCT/IB98/01298, PCT/IB98/01299, PCT/IB98/01300, and PCT/IB98/01301, all Filed Aug. 20, 1998.

Cobalt–Substitution in technischen Hartmetallen; H. Grewe 1986.

Translation of above document; PTO 99–2840, 1999.

Farooq, T. et al., "73 A Study of Alternative Matrices for WC Hardmetals," PM 1990's, Int. Conf. Powder Metall. (1990), Issue 2, 388–94, Inst. Met., London, U.K., pp. 388–394.

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 1–140 (pp. 87–94 English).

"Binary Alloy Phase Diagrams," Second Edition, Vol. 2.0 ed., Ed. Massalski, T.B. et al, pp. 971, 1047–1050 & 1179–1265, ASM International.

Guillermet, A.F., "The Co–Fe–Ni–W–C Phase Diagram: A thermodynamic Description and Calculated Sections for (Co–Fe–Ni) Bonded Cemented WC Tools," Z. Metallkd. (1989), 80(2), pp. 83–94.

Crook, P., "Cobalt and Cobalt Alloys," Metals Handbook, Tenth Edition, Vol. 2 Properties and Selection: Nonferrous Alloys and Special–Purpose Materials (1990), pp. 446–454, ASM International.

Betteridge, W., "Cobalt and Its Alloys," Ellis Horwood Ltd., Halsted Press: a division of John Wiley & Sons, New York, 1982, pp. 41–59.

"Cobalt Facts," Section 10, Cobalt Supply & Demand 1995, pp. 105–112, The Cobalt Development Institute, Essex, U.K.

"Cobalt Monograph," 1960, pp. 170–240. Ed. Centre D'Information du Cobalt, Brussels, Belgium.

Holleck, H. et al., "Constitution of Cemented Carbide Systems," Int. J. Refract. Hard Met. 1, (3), pp. 112–116 (Sep. 1982).

(List continued on next page.)

*Primary Examiner*—Ngoclan Mai
*Attorney, Agent, or Firm*—Stanislav Antolin

[57] ABSTRACT

Cermets having a Co—Ni—Fe-binder are described. The Co—Ni—Fe-binder is unique in that even when subjected to plastic deformation, the binder substantially maintains its face centered cubic crystal structure and avoids stress and/or strain induced phase transformations. Stated differently, the Co—Ni—Fe-binder exhibits reduced work hardening.

46 Claims, 13 Drawing Sheets

OTHER PUBLICATIONS

Brabyn, S. M. et al., "Effects of the Substitution of Nickel for Cobalt in WC Based Hardmetal," Proceedings of the 10th Plansee—Seminar 1981 (Metalwork Plansee, Reutte, Austria, Jun. 1–5, 1981) vol. 2, pp. 675–692, Ed. H. M. Ortner.

Schleinkofer, U., et al., "Fatigue of Cutting Tool Materials," Proceedings of the Sixth International Fatigue Congress, 1996, Berlin, Germany, pp. 1639–1644, "Fatigue '96,'" vol. III, Ed. Lütjering & Nowack.

Schleinkofer, U. et al., "Fatigue of Hard Metals and Cermets," Materials Science and Engineering A209 (1996), pp. 313–317.

Schleinkofer, U. et al., "Microstructural Processes During Subcritical Crack Growth in Hard Metals and Cermets under Cyclic Loads," Materials Science and Engineering A209 (1996), pp. 103–110.

Schleinkofer, U., "Fatigue of Hard Metals and Cermets Under Cyclically Varying Stress," (German Language and English Translation), Thesis submitted to the Technical Faculty of the University of Erlangen–Nürnberg, 1995, pp. 11–12, 96–100, 199–203, & 207.

Schleinkofer, U. et al., "Fatigue of Hard Metals and Cermets–New Results and a Better Understanding," Int'l. J. of Refractory Metals & Hard Materials 15 (1997), pp. 103–112.

Schleinkofer, U. et al., "Fatigue of Hard Metals and Cermets–The Present Knowledge and its Technical Importance and Application," Proceedings of the 1996 World Congress on Powder Metallurgy & Particular Materials, pp. 18–85 to 18–96, reprinted from Advances in Powder Metallurgy & Particulate Materials–1996.

Brookes, K. J. A., "World Directory and Handbook of Hardmetals and Hard Materials," Sixth Edition, International Carbide Data, pp. D15, D19, D31, D38, D44, D63, D78, D79, D82, D87, D96, D143, D175, D182, D223, D234, D237A.

Moskowitz, D. et al., "High–Strength Tungsten Carbides," International Journal of Powder Metallurgy 6 (4) 1970, pp. 55–64.

Prakash, L. J., "The Influence of Carbide Grain Size and Binder Composition on the Properties of Cemented Carbides," Horizons in Powder Metallurgy (Proc. Of the 1986 International PM Conf. And Exhibition, Dusseldorf, Jul. 7–11, 1986) Part 1, pp. 261–264 (1986).

Prakash, L. et al., "The Influence of the Binder Composition on the Properties of WC–Fe/Co/Ni Cemented Carbides," Mod. Dev. Powder Metall. (1981), 14, pp. 255–268.

Roebuck, B., "Magnetic Moment (Saturation) Measurements on Hardmetals," National Physical Laboratory, Dec. 1994, DMM(A)146, pp. 1–12.

Guilemany, J. M., et al., "Mechanical–Property Relationships of Co/WC and Co–Ni–Fe/WC Hard Metal Alloys," International Journal of Refractory Metals and Hard Materials 12 (1993–1994), pp. 199–206.

Gabriel, A., et al., "New Experimental Data in the C–Fe–W, – Co–W, C–Ni–W, C–Fe–Ni–W and C–Co–Ni–W Systems Application to Sintering Conditions of Cemented Carbides Optimization of Steel Binder Composition by Partial Factorial Experiments," Int. Inst. of the Science of Sintering Conf. held at Herceg–Novi, Yugoslavia (Sep. 1985), pp. 379–393, published by Plenum Press.

Gabriel, A. et al., "New Experimental Data in the C–Co–W, C–Fe–W, C–Ni–W C–Fe/Ni–W and C–Co/Ni–W Systems and Their Applications to Sintering Conditions," 11th International Plansee Seminar '85, (May 20–24, 1985, Reutte, Tirol, Austria), vol. 2, pp. 509–525, Ed. H. Bildstein & H. M. Ortner.

Mankins, W. L., et al., "Nickel and Nickel Alloys," Metals Handbook, Tenth Edition, vol. 2, Properties and Selection: Nonferrous Alloys and Special–Purpose Materials (1990), pp. 428–445, ASM International.

Uhrenius, B., et al., "On the Composition of Fe–Ni–Co–Wc– Based Cemented Carbides," International Journey Of Refractory Metals And Hard Materials 15 (1997), pp. 139–149.

Schubert, W–D., et al., "Phase Equilibria in the Systems Co–Mo–W–C and Ni–Mo–W–C," Translated from German, High Temperatures–High Pressures, 1982, Vo. 14, pp.87–100.

Raynor, G. V., et al., "Phase Equilibria in Iron Ternary Alloys, A Critical Assessment of the Experimental Literature," The Institute of Metals, 1988, pp. 7, 15, 16, 27–34, 71–80, 140–142, and 213–288.

Prakash, L., "Properties of Tungsten Carbides with an Iron–Cobalt–Nickel Binder in Sintered and Heat–Treated States" (German Language and English Translation), KFK–Nachr. (1979), 11(2), pp. 35–42, Inst. Mater.–Festkoerperforsch., Karlsruhe, Germany.

Sundman B., et al., "The Thermo–Calc Databank System," Calphad, vol. 9, No. 2, 1985, pp. 153–190.

Doi, A. et al., "Thermodynamic Evaluation of Equilibrium Nitrogen Pressure and WC Separation in Ti–W–C–N System Carbonitride," 11th International Plansee Seminar '85 (May 20–24, 1985, Reutte, Tirol, Austria), vol. 1, pp. 825–843, Ed. H. Bildstein & H. M. Ortner.

Gustafson, P., "Thermodynamic Evaluation of C–W System," Materials Science and Technology, Jul., 1986, vol. 2, pp. 653–658.

Prakash, L. J., "Weiterentwicklung von Wolframcarbid Hartmetallen unter Verwendung von Eisen–Basis–Bindelegierungen [Development of Tungsten Carbide Hardmetals Using Iron–Based Binder Alloys]," KfK 2984, Institute for Materials and Solid States Research by Kernforschungszentrum in Karlsruhe, Germany, 1980, pp. 1–221 (German Language).

Ramqvist, L., "Wetting of Metallic Carbides by Liquid Copper, Nickel, Cobalt and Iron," International Journal of Powder Metallurgy 1 (4), 1965, pp. 2–21.

Warren, R., "The Wetting of the Mixed Carbide, 50 w/o WC/50 w/o TiC by Cobalt, Nickel and Iron and Some of Their Alloys," International Journal of Powder Metallurgy 4 (1), 1968, pp. 51–60.

Yin Zhimin et al., "Microstructure and Properties of WC–10 (Fe,Co,Ni) Cemented Carbides," J. Cent.–South Inst. Min. Metall., vol. 25, No. 6, Dec. 1994, pp. 719–722.

Zhang Li, et al, "A New Hardmetal for Mining with Ni–Co Binder," Int. J. of Refractory Metals & Hard Materials 14 (1996), pp. 245–248.

Thümmler, F., et al, "Ergebnisse Zur Weiterentwicklung Von Hartstoffen Und Hartmetallen," Proc. Plansee–Semin., 10th (1981), vol. 1, pp. 459–476, Metallwork Plansee GmbH, Reutte, Austria. (English Translation).

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 57–65 including English translation of Oberacker, R., et al., "Properties of Tungsten Carbide Hard Metals with Fe–Co–Ni Binder Alloys, Part I: Effect of the Composition, including Carbon Content," pp. 57–65.

Holleck, H., et al., 1977 Annual Report, Aufbau, Herstellung, und Eigenschaften hochschmelzender Verbindungen and Systeme (Harstoffe un Hartmetalle), KfK–Ext. 6/78–1, Institute for Materials and Solid State Research, Kernforschungszentrum in Karlsruhe, Germany, pp. 66–77 including English translation of Prakash, L., "Properties of Tungsten Carbide Hard Metals with Fe–Co–Ni Binder Alloys, Part II: Effect of Heat Treatment," pp. 66–77.

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 78–86 including English translation of Oberacker, R., et al., "Wettability of Tungsten Carbide By Fe–Co–Ni Binder Alloys," pp. 78–86.

Raynor, G. V., et al., "Phase Equilibria in Iron Ternary Alloys, A Critical Assessment of the Experimental Literature," The Institute of Metals, 1988, pp. 247–255.

"Binary Alloy Phase Diagrams," Second Edition, vol. 1.0 ed., Ed. Massalski, T. B. et al, pp. 136–138, 269–270, 355–356, 471–472, 571, 725–727, 835–836, 902–905.

Roebuck, B., et al., "Miniaturised thermomechanical tests on hardmetals and cermets" in ed., Sarin, V., "Science of Hard Materials—5," Proceedings of the 5$^{th}$ International Conference on the Science of Hard Materials, Maui, Hawaii, Feb. 20–24, 1995, Materials Science and Engineering, Elsevier Publishing Company, vol. A209, Nos. 1–2, pp. 358–365.

Suzuki, H., et al, "Effects of Surface–Grinding on Mechanical Properties of WC–Co Alloy", Journal of the Japan Institute of Metals (1974), vol. 38, No. 7, pp. 604–608 (Japanese Language with some English Translation).

Suzuki, H., et al, "Room–Temperature Transverse–Rupture Strength of WC–10% Ni Cemented Carbide", J. Japan Inst. Met. 41 (6), Jun. 1977, pp. 559–563(Japanese Language with some English Translation).

Suzuki, H., et al, Properties of WC–10% (Ni–Fe) Alloys, Department of Metallurgy, Faculty of Engineering, University of Tokyo, Tokyo, pp. 26–31 (Japanese Language with some English Translation).

"Standard Test Method for Flexural Strength of Advanced Ceramics at Ambient Temperature," (Designation: C 1161–90) reprinted from Annual Book of ASTM Standards, American Society for Testing and Materials, Philadelphia, PA.

Prakash, L., et al, "Properties of Tungsten Carbides with Iron–Cobalt–Nickel Alloys as Binders," Sixth International Powder Metallurgy Conference, Dresden, Germany Democratic Republic, 1977, pp. 39–1 –39–16, preprint (German and English Translation).

Thümmler, F., et al, "Ergebnisse Zur Weiterentwicklung Von Hartstoffen Und Hartmetallen," (German Language), Proc. Plansee–Semin., 10th (1981), vol. 1, pp. 459–476, Metallwork Plansee GmbH, Reutte, Austria.

Penrice, T., "Alternative Binders for Hard Metals," J. Materials Shaping Technology, vol. 5, No. 1, 1987, pp. 35–39, 1987 Springer–Verlag New York Inc.

U.S. application No. 08/918993, Heinrich et al., filed Aug. 27, 1997.

U.S. application No. 08/918990, Heinrich et al., filed Aug. 27, 1997.

U.S. application No. 08/918979, Heinrich et al., filed Aug. 27, 1997.

U.S. application No. 08/918982, Heinrich et al., filed Aug. 27, 1997.

U.S. application No. 08/921996, Heinrich et al., filed Aug. 27, 1997.

Thakur, Dr. Babu N., "The Role of Metal Powders in Manufacturing Diamond Tools," SME Technical Paper, MR85–307, Superabrasives '85 Conference, Apr. 22–25, 1985, Chicago, pp. Title Page–17.

Kennametal Inc., Labrobe, PA, "Hot–Press Diamond Matrix Powders," Publication No. ML86–1(2.5)C6, 1986, pp. Title Page–31.

Kennametal Inc. Latrobe, PA, "Infiltration Diamond Matrix Powders," Publication No. ML86–4(3)G6, 1986, Title Page–27.

Macro Division of Kennametal Inc., Port Coquitlam, B.C., Canada, "Cobamet Alloy Powders," Publication No. CT6086–2, 1986, one page.

Macro Division of Kennametal Inc., Port Coquitlam, B.C., Canada, "Cobamet Alloys," Publication No. AM89–10, 1989, one page.

Table I, entitled "Cobamet Alloy Powder," one page.

CERMET HAVING A BINDER WITH IMPROVED PLASTICITY

BACKGROUND

Cermets are composite materials comprised of a hard component, which may or may not be interconnected three dimensionally, and a binder that ties together or binds the hard component. An example of a traditional cermet is a tungsten carbide (WC) cermet (WC-cermet), also known as cobalt cemented tungsten carbide and WC—Co. Here, the hard component is WC while the binder is cobalt (Co-binder) as, for example, a cobalt-tungsten-carbon alloy. This Co-binder is about 98 weight percent (wt. %) cobalt.

Cobalt is the major binder for cermets. For example, about 15 percent of the world's annual primary cobalt market is used in the manufacture of hard materials including WC-cermets. About 26 percent of the world's annual primary cobalt market is used in the manufacture of superalloys developed for advanced aircraft turbine engines-a factor contributing to cobalt being designated a strategic material. Up to about 45 percent of the world's primary cobalt production is located in politically unstable regions. These factors not only contribute to the high cost of cobalt but also explain cobalt's erratic cost fluctuations. Therefore, it would be desirable to reduce the amount of cobalt used as binder in cermets.

Prakash et al. attempted to achieve this goal in their work relating to WC-cermets by substituting an iron rich iron-cobalt-nickel binder (Fe—Co—Ni-binder) for the Co-binder. (see e.g., L. J. Prakash, *Doctoral Thesis,* Kernforschungszentrum Karlsruhe, Germany, Institute Fuer Material-und Festkoeperforschung, 1980 and L. J. Prakash et. al., "The Influence Of The Binder Composition On The Properties Of WC—Fe/Co/Ni Cemented Carbides" Mod. Dev. Powder Metall (1981), 14, 255–268). According to Prakash et al., WC-cermets having an iron rich Fe—Co—Ni-binder were strengthened by stabilizing a body centered cubic (bcc) structure in the Fe—Co—Ni-binder. This bcc structure was achieved by a martensitic transformation.

Guilemany et al. studied the mechanical properties of WC-cermets having a Co-binder and enhanced corrosion resistant WC-cermets having a nickel rich nickel-iron substituted Co-binder at high binder contents made by sintering followed by HIPping. (see e.g., Guilemany et al., "Mechanical-Property Relationships of Co/WC and Co—Ni—Fe/WC Hard Metal Alloys," Int. J. of Refractory & Hard Materials (1993–1994) 12, 199–206).

Metallurgically, cobalt is interesting since it is allotropic—that is, at temperatures greater than about 417° C., pure cobalt's atoms are arranged in a face centered cubic (fcc) structure and at temperatures less than about 417° C., pure cobalt's atoms are arranged in a hexagonal close packed (hcp) structure. Thus, at about 417° C., pure cobalt exhibits an allotropic transformation, i.e., the fcc structure changes to the hcp structure (fcc→hcp transformation). Alloying cobalt may temporarily suppress the fcc→hcp transformation stabilizing the fcc structure. For example, it is known that alloying cobalt with tungsten and carbon to form a Co—W—C alloy (Co-binder) temporarily stabilizes the fcc structure. (See e.g., W. Dawihl et al., Kobalt 22 (1964) 16). It is well known however, that subjecting a Co—W—C alloy (Co-binder) to stress and/or strain induces the fcc→hcp transformation. (See e.g., U. Schleinkofer et al., Materials Science and Engineering A194 (1995) 1 and Materials Science and Engineering A194 (1996) 103) In WC-cermets having a Co-binder the stress and/or strain developed during the cooling of the cermets following densification (e.g., vacuum sintering, pressure sintering, hot isostatic pressing . . . etc.) may induce the fcc→hcp transformation. Also, it is well know that cyclic loading, such as cyclic loading that may propagate subcritical crack growth, of WC-cermets having a Co-binder induces the fcc→hcp transformation. Applicants have determined that in cermets the presence of the hcp structure in the binder can be detrimental since this can result in the embrittlement of the binder. Thus, it would be desirable to find a binder that not only provides cost savings and cost predictability but also does not exhibit embrittlement mechanisms such as local fcc→hcp transformations.

For the foregoing reasons, there is a need for a cermet having a binder with higher plasticity compared to the Co-binder that can be inexpensively manufactured.

SUMMARY

Applicants have determined that the presence of the hcp structure in the binder of a cermet may be detrimental. The hcp structure results in the embrittlement of the binder. Applicants have identified a solution to the problem that includes using a binder having higher plasticity. The present invention is directed to a cermet having a binder, preferably a binder having a fcc structure, with improved plasticity (the plastic binder possesses reduced work hardening) that is stable even under high stress and/or strain conditions. The cermet of the present invention also satisfies the need for a low cost cermet-having improved cost predictability. The cermet comprises a hard component and a binder with improved plasticity that improves the crack resistance of the cermet. Although relative to a comparable cermet having a Co-binder, the cermet having the plastic binder may have a lower hardness, the overall hardness of the inventive cermet may be adjusted by varying the grain size distribution of the hard component and/or amount of the hard component without sacrificing strength and/or toughness. Preferably, the hard component amount is increased to increase the hardness of the cermet without sacrificing strength and/or toughness the cermet. One advantage of the cermet of the present invention includes improved crack resistance and reliability, which may be attributed to the plasticity of the binder, relative to a comparable cermet having a Co-binder. Another advantage of the cermet of the present invention includes improved corrosion resistance and/or oxidation resistance relative to a comparable cermet having a Co-binder.

A preferred cermet of the present invention comprises one having a cobalt-nickel-iron-binder (Co—Ni—Fe-binder). The Co—Ni—Fe-binder comprises at least about 40 wt. % cobalt but not more than about 90 wt. % cobalt, at least about 4 wt. % nickel, and at least about 4 wt. % iron. Applicants believe that a Co—Ni—Fe-binder comprising not more than about 36 wt. % Ni and not more than about 36 wt. % Fe is preferred. A preferred composition of the Co—Ni—Fe-binder comprises about 40 wt. % to 90 wt. % Co, about 4 wt. % to 36 wt. % Ni, about 4 wt. % to 36 wt. % Fe, and a Ni:Fe ratio of about 1.5:1 to 1:1.5. Preferably, the Co—Ni—Fe-binder comprises a face centered cubic (fcc) crystal structure. This cermet having a Co—Ni—Fe-binder may be produced at a lower and less fluctuating cost than a cermet having a Co-binder. Advantages of cermets having a Co—Ni—Fe-binder include improved crack resistance and reliability, and improved corrosion resistance and/or oxidation resistance, both relative to comparable cermets having a Co-binder.

Cermets of the present invention comprise at least one hard component comprising at least one of borides, carbides, nitrides, oxides, silicides, their mixtures, their solid solutions or combinations of the preceding and a plastic binder that is stable even under high stress and/or strain conditions, preferably a Co—Ni—Fe-binder. The plastic binder of the present invention is unique in that even when subjected to plastic deformation, the binder maintains its fcc crystal structure and avoids stress and/or strain induced transformations. Applicants have measured strength and fatigue performance in cermets having Co—Ni—Fe-binders up to as much as about 2400 megapascal (MPa) for bending strength and up to as much as about 1550 MPa for cyclic fatigue (200,000 cycles in bending at about room temperature). Applicants believe that substantially no stress and/or strain induced phase transformations occur in the Co—Ni—Fe-binder up to those stress and/or strain levels that leads to superior performance.

In this context, the inventive cermets may be referred to by the composition making up a majority of the hard component. For example, if a majority of the hard component comprises a carbide, the cermet may be called a carbide-cermet. If a majority of the hard component comprises tungsten carbide (WC), the cermet may be called a WC-cermet. In a like manner, the cermets may be called, for example, boride-cermets, nitride-cermets, oxide-cermets, silicide-cermets, carbonitride-cermets, oxynitride-cermets. Thus, if a majority of the hard component comprises titanium carbonitride (TiCN), the cermet may be called a titanium carbonitride cermet or TiCN-cermet. This nomenclature should not be limited by the above examples; instead, the above examples form a basis that bring a common understanding to those skilled in the art.

The invention illustratively disclosed herein may suitably be practiced in the absence of any element, step, component, or ingredient which is not specifically disclosed herein.

DRAWINGS

These and other features, aspects, and advantages of the present invention will become better understood with reference to the following description, appended claims, and accompanying drawings where:

FIG. 1 shows an optical photomicrograph of the microstructure of a prior art WC-cermet having a Co-binder made by vacuum sintering at about 1550° C.;

FIG. 1*a* shows a black and white image of FIG. 1 of the type used for area fraction analysis of the microstructure of a prior art WC-cermet having a Co-binder made by vacuum sintering at about 1550° C.;

FIG. 2 shows (for comparison with FIG. 1) an optical photomicrograph of the microstructure of a WC-cermet having a Co—Ni—Fe-binder of the present invention made by vacuum sintering at about 1550° C.;

FIG. 2*a* shows (for comparison with FIG. 1*a*) a black and white image of FIG. 2 of the type used for area fraction analysis of the microstructure of the WC-cermet having a Co—Ni—Fe-binder of the present invention made by vacuum sintering at about 1550° C.;

Figure 14:
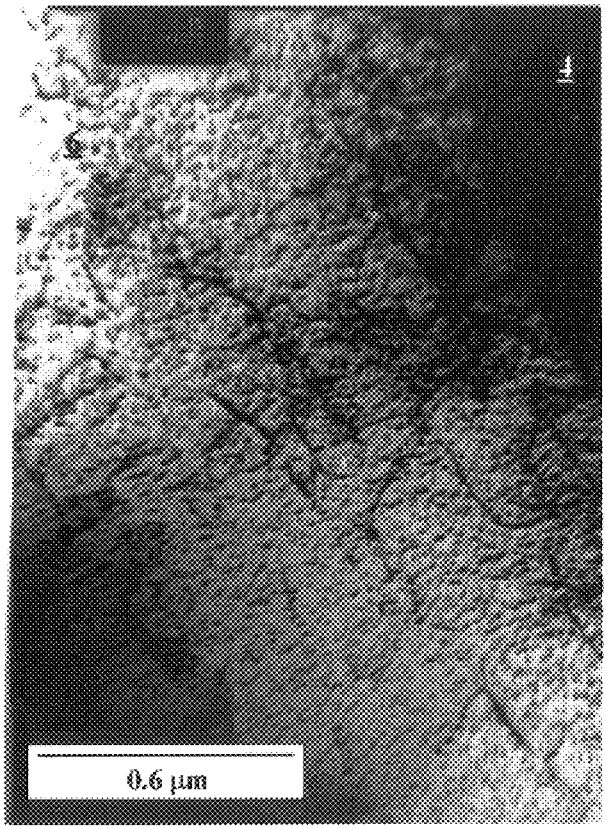
Figure 14A:
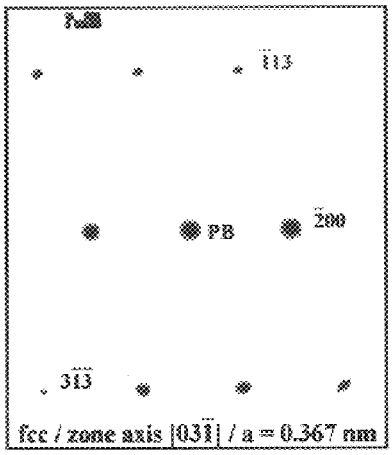
Figure 14B:
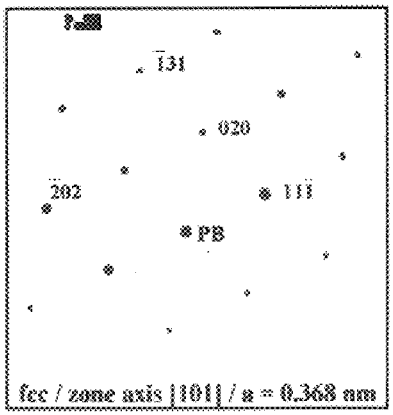
Figure 15:
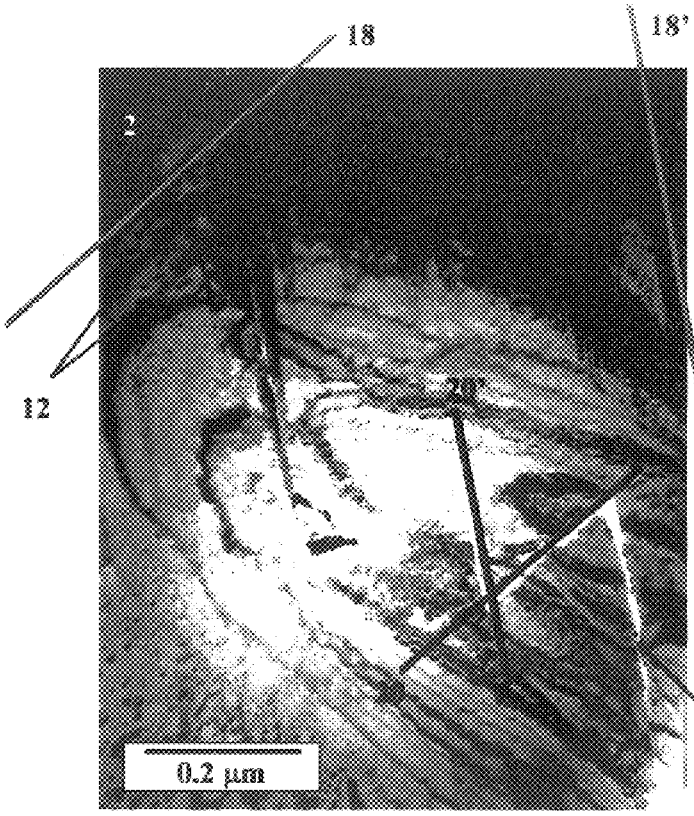
Figure 15A:
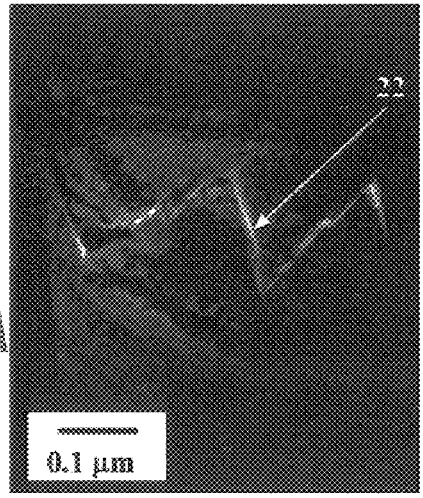
Figure 16:
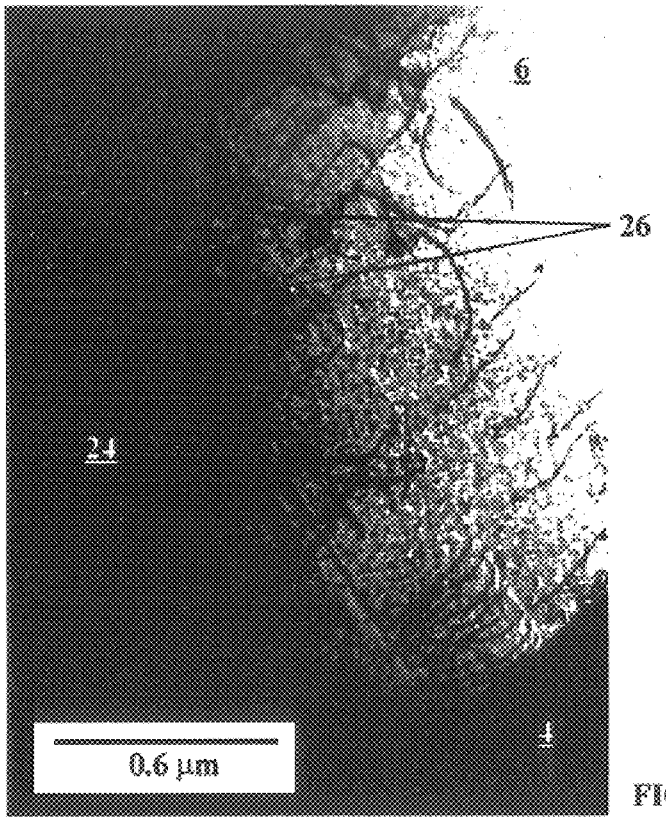
Figure 16A:
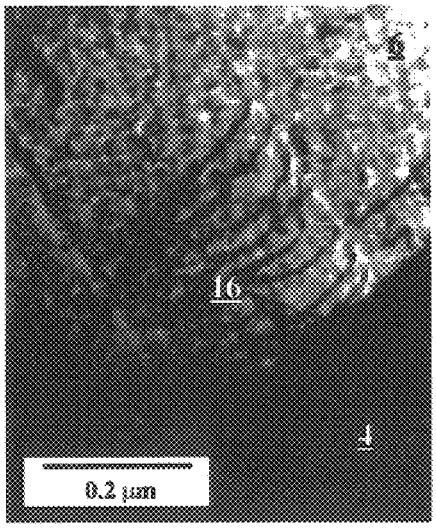
Figure 17:
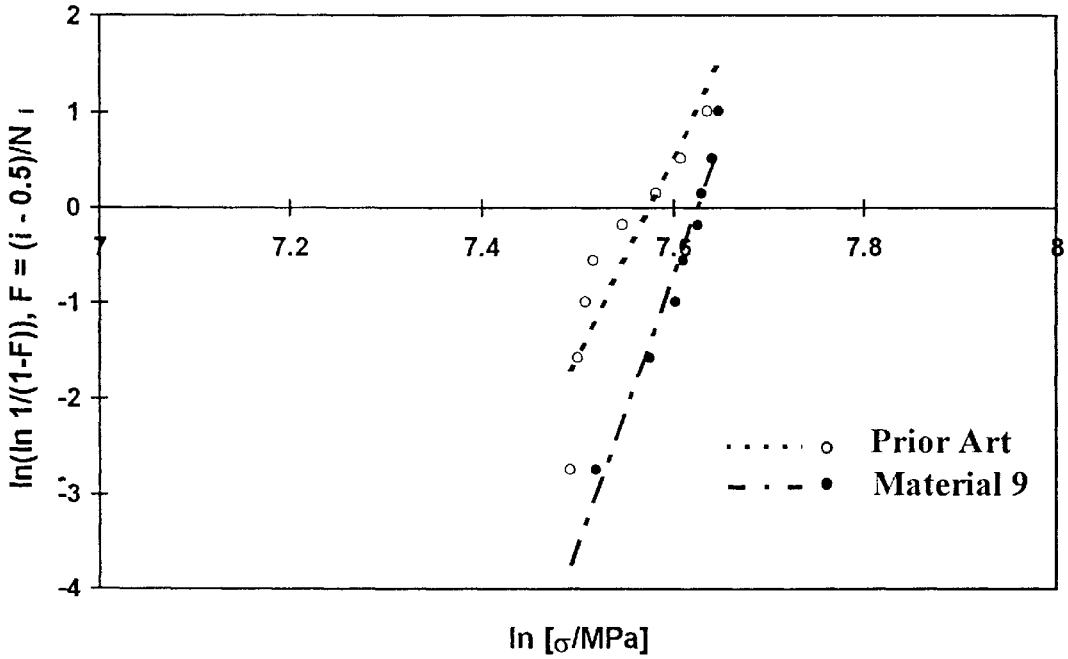
Figure 18:
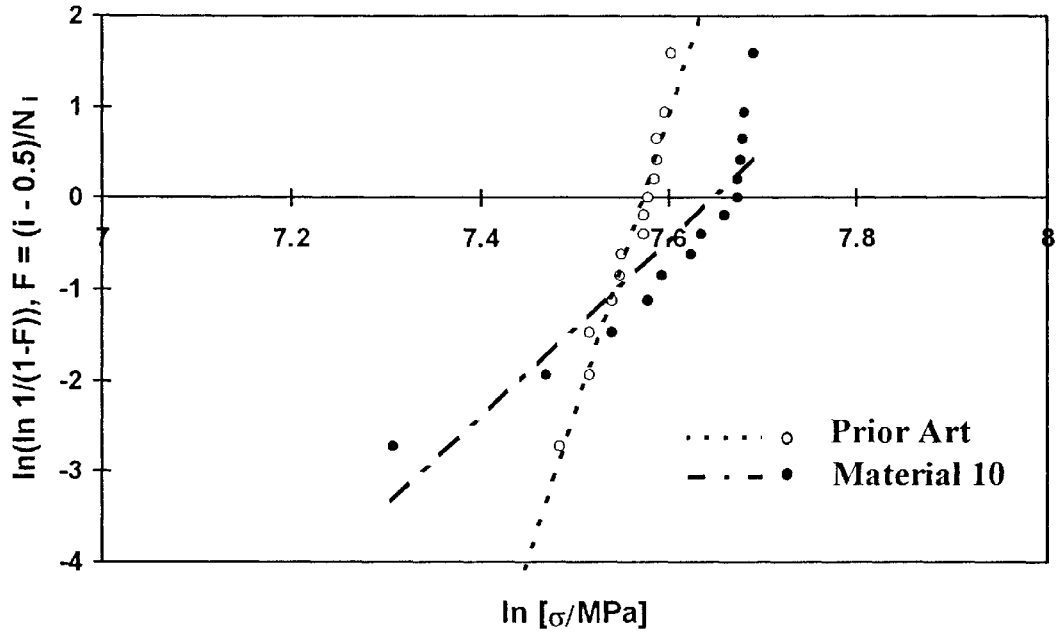
Figure 19:
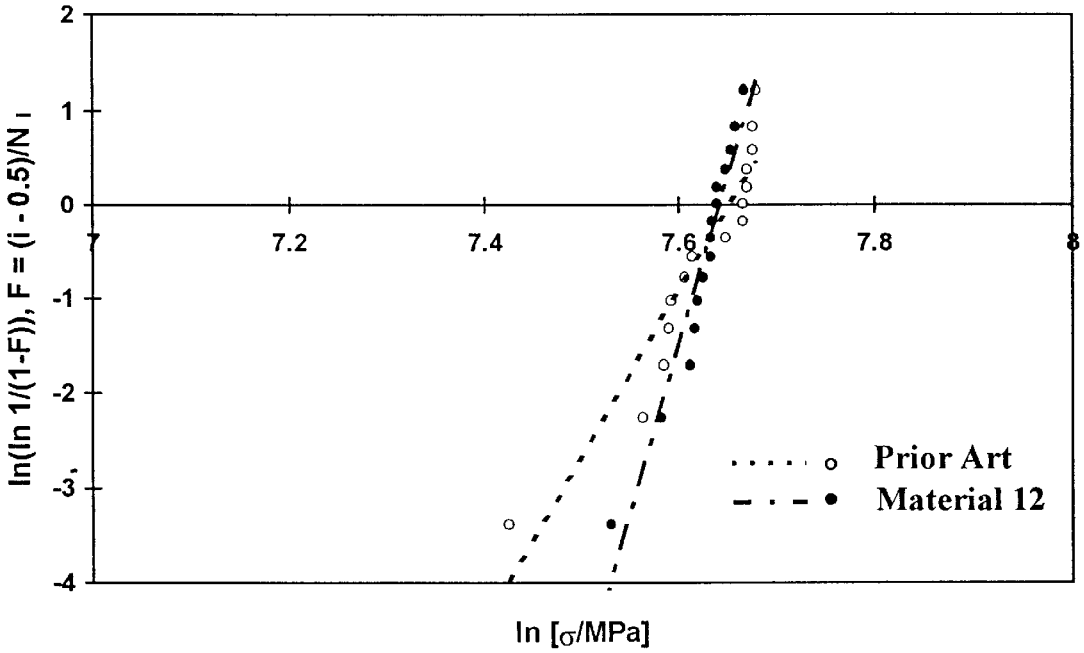
Figure 20:
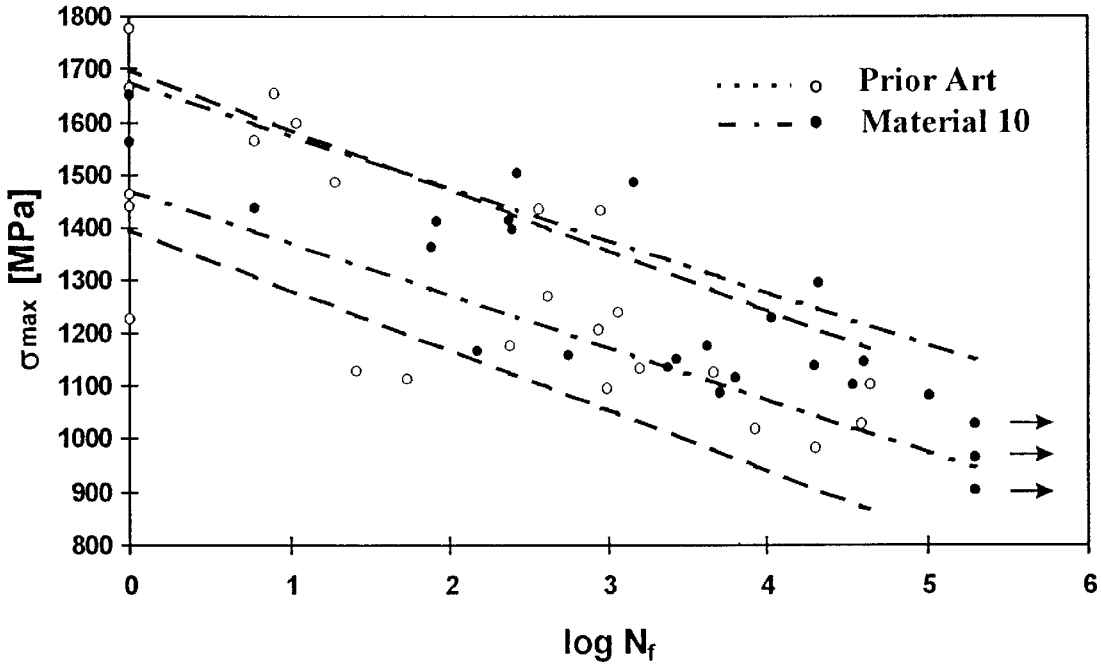
Figure 21:
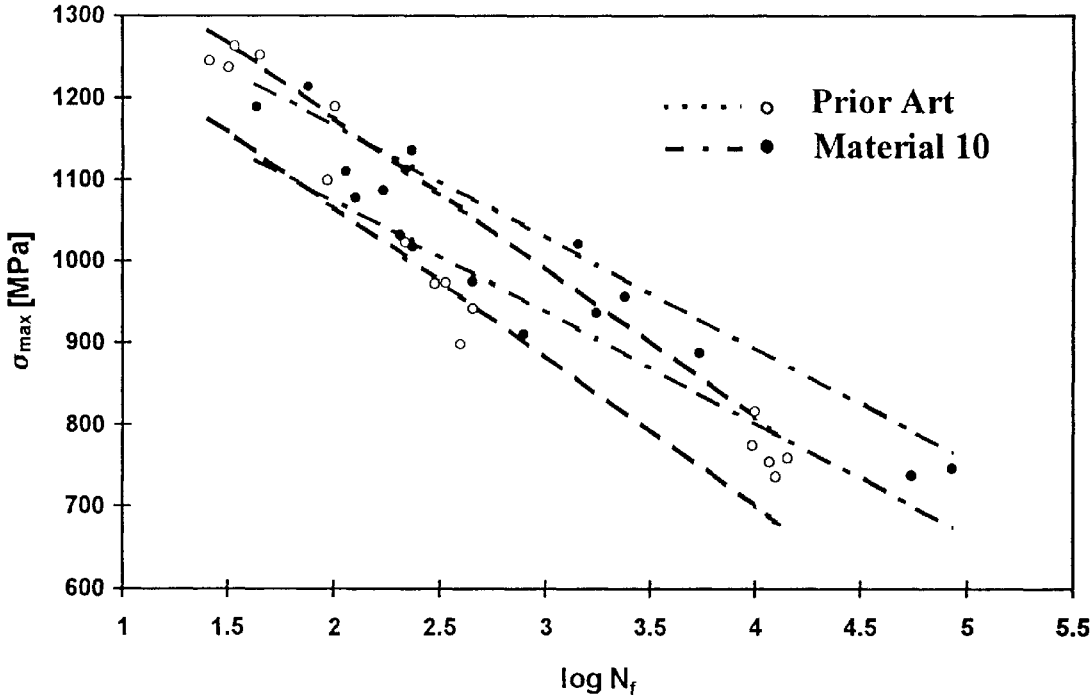
Figure 22:
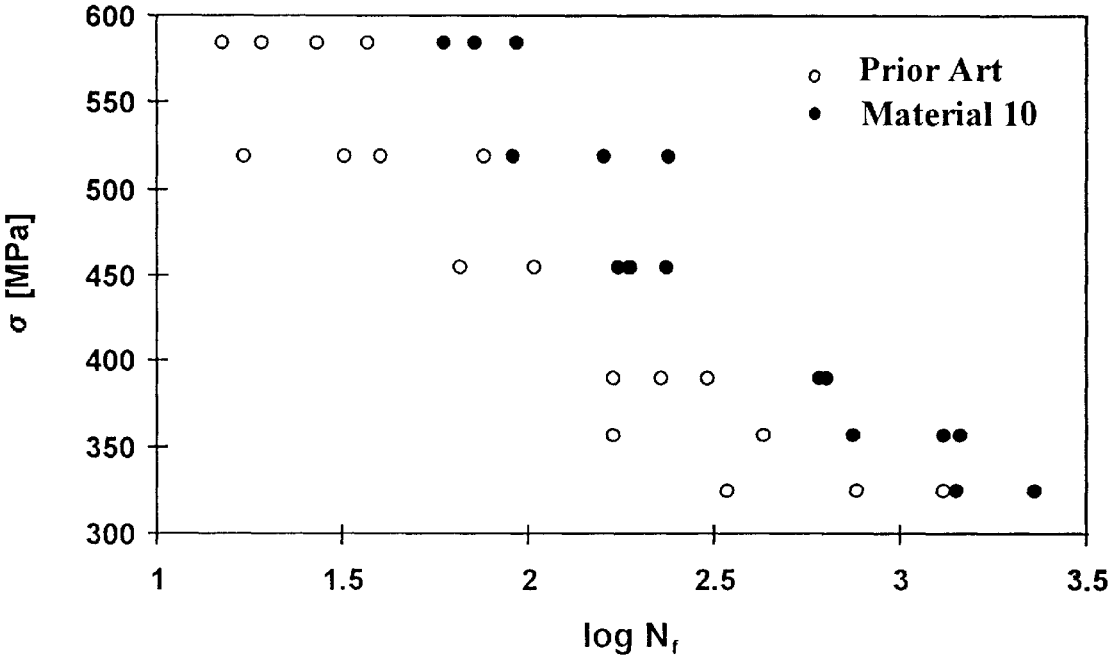

FIGS. 14, 14*a*, and 14*b* show a comparative TEM photomicrograph, the results of selected area diffraction (SAD) using TEM along the $[03\bar{1}]$ zone axis, and the results of SAD using TEM along the [101] zone axis of a binder pool in a WC-cermet having a Co—Ni—Fe-binder of the present invention made by vacuum sintering at about 1535° C.;

FIGS. 15 and 15*a* show a TEM photomicrograph of a binder pool in a prior art WC-cermet having a Co-binder made by vacuum sintering at about 1535° C. illustrating the cracking mechanism caused by a high stacking fault concentrations;

FIGS. 16 and 16*a* show for comparison a TEM photomicrograph of a binder pool in a WC-cermet having a Co—Ni—Fe-binder of the present invention made by vacuum sintering at about 1535° C. illustrating the presence of plastic deformation and a high unconstrained dislocation density in these inventive WC-cermets rather than the cracking mechanism caused by stacking faults in the prior art WC-cermets;

FIG. 17 shows Weibull distribution plots of the transverse rupture strengths (TRS) for a prior art WC-cermet having a Co-binder (represented by open circles "○" and the - - - - - line) a comparative WC-cermet having a Co—Ni—Fe-binder of the present invention (represented by dots "●" and the - - - - - - line), both made by vacuum sintering at about 1535° C.;

FIG. 18 shows Weibull distribution plots of the TRS for a prior art WC-cermet having a Co-binder (represented by open circles "○" and the - - - - - line) a comparative WC-cermet having a Co—Ni—Fe-binder of the present invention (represented by dots "●" and the - - - - - - line), both made by vacuum sintering at about 1550° C.;

FIG. 19 shows Weibull distribution plots of the TRS for a prior art WC-cermet having a Co-binder (represented by open circles "○" and the - - - - - line) and a comparative WC-cermet having a Co—Ni—Fe-binder of the present invention (represented by dots "●" and the - - - - - - line), both made by pressure sintering at about 1550° C.;

FIG. 20 shows bending fatigue performance data-stress amplitude ($\sigma_{max}$) as a function of cycles to failure at about room temperature in air-for a prior art WC-cermet having a Co-binder (represented by open circles "○" and the - - - - - line) and a comparative WC-cermet Co—Ni—Fe-binder of the present invention (represented by dots "●" and the - - - - - - line), both made by vacuum sintering at about 1550° C.;

FIG. 21 shows bending fatigue performance data-stress amplitude ($\sigma_{max}$) as a function of cycles to failure tested at about 700° C. in air-for a prior art WC-cermet having a Co-binder (represented by open circles "○" and the - - - - - line) and a comparative a WC-cermet having a Co—Ni—Fe-binder of the present invention comprising (represented by dots "●" and the - - - - - - line), both made by vacuum sintering at about 1550° C.; and FIG. 22 shows low cycle tensile-compression fatigue performance data-stress amplitude ($\sigma_{max}$) as a function of cycles to failure tested at about room temperature in air-for a prior art WC-cermet having a Co-binder (represented by open circles "○" and the - - - - - line) and a comparative a WC-cermet having a Co—Ni—Fe-binder of the present invention (represented by dots "●" and the - - - - - - line), both made by vacuum sintering at about 1550° C.

DESCRIPTION

A cermet of the present invention having a binder with improved plasticity (a plastic binder exhibits reduced work hardening) may suitably comprise at least one hard component and a binder which, when combined with the at least one hard component, possess improved properties including, for example, improved resistance to subcritical crack growth under cycle fatigue, improved strength, and, optionally, improve oxidation resistance and/or improved corrosion resistance. The binder may suitably comprise any number of constituents that, when combined, stabilize a face centered cubic (fcc) structure in the binder that is stable even when the cermet is subjected to high stress and/or strain. For example, applicants have measured superior strength and fatigue performance in cermets having Co—Ni—Fe-binders up to as much as about 2400 megapascal (MPa) for bending strength and up to as much as about 1550 MPa for cyclic fatigue (200,000 cycles in bending at about room temperature). Applicants believe that substantially no stress and/or strain induced phase transformations occur in the Co—Ni—Fe-binder up to those stress and/or strain levels.

Optionally, the cermet of the present invention may exhibit corrosion resistance and/or oxidation resistance in an environment (e.g., a solid, a liquid, a gas, or any combination of the preceding) due to either (1) chemical inertness of the cermet, (2) formation of a protective barrier on the cermet from the interactions of the environment and the cermet, or (3) both.

Cermets of the present invention have a binder that may comprise cobalt and one or two or more metals of IUPAC groups 8, 9, 10, and 11, their mixtures, and their alloys. A preferred binder of the present invention comprises a Co—Ni—Fe-binder comprising a face centered cubic (fcc) structure that is stable even when subjected to high stresses and/or strains. The Co—Ni—Fe-binder comprises at least about 40 wt. % cobalt, but not more than about 90 wt. % cobalt, at least about 4 wt. % nickel, and at least about 4 wt. % iron. Applicants believe that a Co—Ni—Fe-binder comprising not more than about 36 wt. % Ni and not more than 36 wt. % Fe is preferred. A preferred composition of the Co—Ni—Fe-binder comprises about 40 wt. % to 90 wt. % Co, about 4 wt. % to 36 wt. % Ni, about 4 wt. % to 36 wt. % Fe, and a Ni:Fe ratio of about 1.5:1 to 1:1.5. A more preferred composition of the Co—Ni—Fe-binder comprises about 40 wt. % to 90 wt. % Co and a Ni:Fe ratio of about 1:1. An even more preferred composition of the Co—Ni—Fe-binder comprises a cobalt:nickel:iron ratio of about 1.8:1:1.

A binder of the cermet of the present invention may suitably comprise any material that forms or assists in forming a highly plastic structure, preferably having a fcc crystal structure, that is substantially stable even when subjected to high stresses and/or strains. It will be appreciated by those skilled in the art that a Co—Ni—Fe-binder may also comprise at least one other alloying element either in place of one or both of nickel and iron and/or in solution with the Co—Ni—Fe-binder and/or as discrete precipitates in the Co—Ni—Fe-binder. Such at least one other alloying element may contribute the physical and/or mechanical properties of the cermet. Whether or not the at least one other alloying element contributes to the properties of the cermet, the least one other alloying element may be included in the Co—Ni—Fe-binder to the extent that the least one other alloying element does not detract from the properties and/or performance of the cermet.

For example, an at least one other alloying element may comprise an alloying element or group of alloying elements that either stabilize and/or advance the formation of a fcc crystal structure that is stable even when subjected to high stresses and/or strains. For a cobalt containing binder, such an at least one other alloying element may comprise one or more of aluminum, boron, copper, titanium, zirconium, carbon, tin, niobium, manganese, platinum, palladium, and vanadium. Preferably, such an at least one other alloying element may comprise one or more metals such as copper, niobium, platinum, and palladium.

It will be appreciated by those skilled in the art that the binder content of the cermets of the present invention is dependent on such factors as the composition and/or geometry of the hard component, the use of the cermet, and the composition of the binder. For example, applicants believe that when the inventive cermet comprises a WC-cermet having a Co—Ni—Fe-binder, the binder content may comprise about 0.2 wt. % to 35 wt. % (preferably 3 wt. % to 30 wt. %), and when the inventive cermet comprises a TiCN-cermet having a Co—Ni—Fe-binder, the binder content may comprise about 0.3 wt. % to 25 wt. % (preferably 3 wt. % to 20 wt. %). As a further example, applicants believe that when an inventive WC-cermet having Co—Ni—Fe-binder is used as a pick-style tool for mining and construction, the binder content may comprise about 5 wt. % to 27 wt. % (preferably about 5 wt. % to 19 wt. %); and when an inventive WC-cermet having Co—Ni—Fe-binder is used as a rotary tool for mining and construction, the binder content may comprise about 5 wt. % to 19 wt (preferably about 5 wt. % to 15 wt. %); and when an inventive WC-cermet having Co—Ni—Fe-binder is used as a screw head punch, the binder content may comprise about 8 wt. % to 30 wt. % (preferably about 10 wt. % to 25 wt. %); and when an inventive cermet having Co—Ni—Fe-binder is used as a cutting tool for chip forming machining of workpiece materials, the binder content may comprise about 2 wt. % to 19 wt. % (preferably about 5 wt. % to 14 wt. %); and when an inventive cermet having Co—Ni—Fe-binder is used as an elongate rotary tool for machining materials, the binder content may comprise about 0.2 wt. % to 19 wt. % (preferably about 5 wt. % to 16 wt. %).

A hard component may comprise at least one of borides, carbides, nitrides, oxides, silicides, their mixtures, their solid solutions or combinations of the proceedings. The metal of the at least one of borides, carbides, nitrides, oxides, or silicides may include one or more metals from international union of pure and applied chemistry (IUPAC) groups 2, 3, (including lanthanides, actinides), 4, 5, 6, 7, 8, 9, 10, 11, 12, 13, and 14. Preferably, the at least one hard component may comprise carbides, nitrides, carbonitrides their mixtures, their solid solutions, or any combinations of the preceding. The metal of the carbides, nitrides, and carbonitrides may comprise one or more metals of IUPAC groups 3, including lanthanides and actinides, 4, 5, and 6; and more preferably, one or more of titanium, zirconium, hafnium, vanadium, niobium, tantalum, chromium, molybdenum, and tungsten.

In this context, inventive cermets may be referred to by the composition making up a majority of the hard component. For example, if a majority of the hard component comprises a carbide, the cermet may be designated a carbide-cermet. If a majority of the hard component comprises tungsten carbide (WC), the cermet may be designated a tungsten carbide cermet or WC-cermet. In a like manner, cermets may be called, for example, boride-cermets, nitride-cermets, oxide-cermets, silicide-cermets, carbonitride-cermets, oxynitride-cermets. For example, if a majority of the hard components comprise titanium carbonitride (TiCN), the cermet may be designated a titanium carbonitride cermet or TiCN-cermet. This nomenclature should not be limited by the above examples and instead forms a basis that bring a common understanding to those skilled in the art.

Dimensionally, the grain size of the hard component of the cermet having a high plasticity binder may range in size from submicron to about 100 micrometers ($\mu$m) or greater. Submicrometer includes nanostructured materials having structural features ranging from about 1 nanometer to about 100 nanometers (0.1 $\mu$m) or more. It will be appreciated by those skilled in the art that the grain size of the hard component of the cermets of the present invention is dependent on such factors as the composition and/or geometry of the hard component, the use of the cermet, and the composition of the binder. For example, applicants believe that when the inventive cermet comprises a WC-cermet having a Co—Ni—Fe-binder, the grain size of the hard component may comprise about 0.1 $\mu$m to about 40 $\mu$m, and when the inventive cermet comprises a TiCN-cermet having a Co—Ni—Fe-binder, the grain size of the hard component may comprise about 0.5 $\mu$m to about 6 $\mu$m. As a further example, applicants believe that when an inventive WC-cermet having Co—Ni—Fe-binder is used as a pick-style tool or a rotary tool for mining and construction, the grain size of the hard component may comprise about 1 $\mu$m to about 30 $\mu$m (preferably about 1 $\mu$m to about 25 $\mu$m); and when an inventive WC-cermet having Co—Ni—Fe-binder is used as a screw head punch, the grain size of the hard component may comprise about 1 $\mu$m to about 25 $\mu$m (preferably about 1 $\mu$m to about 15 $\mu$m); and when an inventive cermet having Co—Ni—Fe-binder is used as a cutting tool for chip forming machining of workpiece materials, the grain size of the hard component may comprise about 0.1 $\mu$m to 40 $\mu$m (preferably about 0.5 $\mu$m to 10 $\mu$m); and when an inventive cermet having Co—Ni—Fe-binder is used as an elongate rotary tool for machining materials, the grain size of the hard component may comprise about 0.1 $\mu$m to 12 $\mu$m (preferably about 8 $\mu$m and smaller).

Applicants contemplate that every increment between the endpoints of ranges disclosed herein, for example, binder content, binder composition, Ni:Fe ratio, hard component grain size, hard component content, . . . etc. is encompassed herein as if it were specifically stated. For example, a binder content range of about 0.2 wt. % to 35 wt. % encompasses about 1 wt. % increments thereby specifically including about 0.2 wt. %, 1 wt. %, 2 wt. %, 3 wt. %, . . . 33 wt. %, 34 wt. % and 35 wt. % binder. While for example, for a binder composition the cobalt content range of about 40 wt. % to 90 wt. % encompasses about 1 wt. % increments thereby specifically including 40 wt. %, 41 wt. %, 42 wt. %, . . . 88 wt. %, 89 wt. %, and 90 wt. % while the nickel and iron content ranges of about 4 wt. % to 36 wt. % each encompass about 1 wt. % increments thereby specifically including 4 wt. %, 5 wt. %, 6 wt. %, . . . 34 wt. %, 35 wt. %, and 36 wt. %. Further for example, a Ni:Fe ratio range of about 1.5:1 to 1:1.5 encompasses about 0.1 increments thereby specifically including 1.5:1, 1.4:1, . . . 1:1, . . . 1:1.4, and 1:1.5). Furthermore for example, a hard component grain size range of about 0.1 $\mu$m to about 40 $\mu$m encompasses about 1 $\mu$m increments thereby specifically including about 1 $\mu$m, 2 $\mu$m, 3 $\mu$m, . . . 38 $\mu$m, 39 $\mu$m, and 40 $\mu$m.

A cermet of the present invention may be used either with or without a coating depending upon the cermets use. If the cermet is to be used with a coating, then the cermet is coated with a coating that exhibits suitable properties such as, for example, lubricity, wear resistance, satisfactory adherence to the cermet, chemical inertness with workpiece materials at use temperatures, and a coefficient of thermal expansion that is compatible with that of the cermet (i.e., compatible thermo-physical properties). The coating may be applied via CVD and/or PVD techniques.

Examples of the coating material, which may comprise one or more layers of one or more different components, may be selected from the following, which is not intended to be all-inclusive: alumina, zirconia, aluminum oxynitride, silicon oxynitride, SiAlON, the borides of the elements for IUPAC groups 4, 5, and 6, the carbonitrides of the elements from IUPAC groups 4, 5, and 6, including titanium carbonitride, the nitrides of the elements from IUPAC groups 4, 5, and 6 including titanium nitride, the carbides of the elements from IUPAC groups 4, 5, and 6 including titanium carbide, cubic boron nitride, silicon nitride, carbon nitride, aluminum nitride, diamond, diamond like carbon, and titanium aluminum nitride.

The cermets of the present invention may be made from a powder blend comprising a powder hard component and a powder binder that may be consolidated by any forming means including, for example, pressing, for example, uniaxial, biaxial, triaxial, hydrostatic, or wet bag (e.g., isostatic pressing) either at room temperature or at elevated temperature (e.g., hot pressing, hot isostatic pressing), pouring; injection molding; extrusion; tape casting; slurry casting; slip casting; or and any combination of the preceding. Some of these methods are discussed in U.S. Pat. Nos. 4,491,559; 4,249,955; 3,888,662; and 3,850,368, the subject matter of which is herein incorporated by reference in its entirety in the present application.

In any case, whether or not a powder blend is consolidated, its solid geometry may include any conceivable by a person skilled in the art. To achieve a shape or combinations of shapes, a powder blend may be formed prior to, during, and/or after densification. Prior densification forming techniques may include any of the above mentioned means as well as green machining or plastic forming the green body or their combinations. Post densification forming techniques may include any machining operations such as grinding, electron discharge machining, brush honing, cutting . . . etc.

A green body comprising a powder blend may then be densified by any means that is compatible with making a cermet of the present invention. A preferred means comprises liquid phase sintering. Such means include vacuum sintering, pressure sintering (also known as sinter-HIP), hot isostatic pressing (HIPping), etc. These means are performed at a temperature and/or pressure sufficient to produce a substantially theoretically dense article having minimal porosity. For example, for WC-cermet having a Co—Ni—Fe-binder, such temperatures may include temperatures ranging from about 1300° C. (2373° F.) to about 1760° C. (3200° F.) and preferably, from about 1400° C. (2552° F.) to about 1600° C. (2912° F.). Densification pressures may range from about zero (0) kPa (zero (0) psi) to about 206 MPa (30 ksi). For carbide-cermet, pressure sintering (as so known as sinter-HIP) may be performed at from about 1.7 MPa (250 psi) to about 13.8 MPa (2 ksi) at temperatures from about 1370° C. (2498° F.) to about 1600° C. (2912° F.), while HIPping may be performed at from about 68 MPa (10 ksi) to about 206 MPa (30 ksi) at temperatures from about 1,310° C. (2373° F.) to about 1760° C. (3200° F.).

Densification may be done in the absence of an atmosphere, i.e., vacuum; or in an inert atmosphere, e.g., one or more gasses of IUPAC group 18; in carburizing atmospheres; in nitrogenous atmospheres, e.g., nitrogen, forming gas (96% nitrogen, 4% hydrogen), ammonia, etc.; or in a reducing gas mixture, e.g., $H_2/H_2O$, $CO/CO_2$, $CO/H_2/CO_2/H_2O$, etc.; or any combination of the preceding.

The present invention is illustrated by the following. It is provided to demonstrate and clarify various aspects of the present invention: however, the following should not be construed as limiting the scope of the claimed invention.

Table 1 summarizes the nominal binder content wt. %, Co:Ni:Fe ratio, cermet type, wt. % 1st component, 1st component size (μm), wt. % 2nd component, 2nd component size (μm), wt. % 3rd component, 3rd component size (μm), milling method (where WBM=wet ball milled and AT=attritor milled), milling time (hr), and densification (Dnsfctn*) method (where VS=vacuum sintered, HIP=hot isostatically pressed, and PS=pressure sintered [also known as sinter-HIP]), temperature (Temp), and time (hr) for a number of WC-cermets and TiCN-cermets within the scope of the present invention. These materials were produced using conventional powder metallurgical technology as described in, for example, "World Directory and Handbook of HARDMETALS AND HARD MATERIALS" Sixth Edition, by Kenneth J. A. Brookes, International Carbide DATA (1996); "PRINCIPLES OF TUNGSTEN CARBIDE ENGINEERING" Second Edition, by George Schneider, Society of Carbide and Tool Engineers (1989); "Cermet-Handbook", Hertel A G, Werkzeuge+Hartstoffe, Fuerth, Bavaria, Germany (1993); and "CEMENTED CARBIDES", by P. Schwarzkopf & R. Kieffer, The Macmillan Company (1960)—the subject matter of which is herein incorporated by reference in its entirety in the present application.

TABLE 1

Examples of WC-Cermets and TiCN-Cermets

| Material # | 1 | 2 | 3 | 4 | 5 | 6 |
|---|---|---|---|---|---|---|
| Binder Content wt. % | 7 | 15 | 22 | 27 | 9.5 | 6 |
| Co:Ni:Fe Ratio | 1.9:1:1 | 1.9:1:1 | 1.8:1:1 | 2.1:1:1 | 1.8:1:1 | 2.6:1:1 |
| Cermet Type | WC | WC | WC | WC | WC | WC |
| wt. % | 93 | 85 | 78 | 73 | 90.5 | 86.5 |
| 1st Component | WC | WC | WC | WC | WC | WC |
| 1st Component size (μm) | 2.5 | 2.5 | 2.5 | 2.5 | ‡ | 8 |
| wt. % 2nd Component | N/A | N/A | N/A | N/A | N/A | 5 Ta(Nb)C |
| 2nd Component size μm | N/A | N/A | N/A | N/A | N/A | 1.5 |
| wt. % 3rd Component | N/A | N/A | N/A | N/A | N/A | 2.5 TiC |
| 3rd Component size (μm) | N/A | N/A | N/A | N/A | N/A | 1.2 |
| Milling Method | AT | AT | AT | AT | AT | AT |
| Milling Time (hr) | 13 | 13 | 11 | 11 | 4.5 | 12 |
| Dnsfctn* Method | PS | PS | PS | PS | VS | PS |
| Temp (° C.) | 1420 | 1400 | 1400 | 1400 | 1570 | 1450 |
| Time (hr) | 1.5 | 1.5 | 1.5 | 1.5 | 1.0 | 1.5 |

TABLE 1-continued

Examples of WC-Cermets and TiCN-Cermets

| Material # | 7 | 8 | 9 | 10 | 11 | 12 |
|---|---|---|---|---|---|---|
| Binder Content wt. % | 18 | 9.5 | 9.3 | 9.6 | 9 | 9.4 |
| Co:Ni:Fe Ratio | 2.5:1:1 | 1.9:1:1.1 | 1.9:1:1.1 | 2:1:1.2 | 2:1:1.1 | 2:1:2.1 |
| Cermet Type | TiCN | WC | WC | WC | WC | WC |
| wt. % | 58 | 90.5 | 90.7 | 90.4 | 91 | 90.6 |
| 1st Component | TiCN | WC | WC | WC | WC | WC |
| 1st Component size (μm) | 1.3 | ‡ | ‡ | ‡ | ‡ | ‡ |
| wt. % 2nd Component | 8 Ta(Nb)C | N/A | N/A | N/A | N/A | N/A |
| 2nd Component size μm | 1.5 | N/A | N/A | N/A | N/A | N/A |
| wt. % 3rd Component | 16 (WC + $Mo_2C$) | N/A | N/A | N/A | N/A | N/A |
| 3rd Component size (μm) | 0.8/1.5 | N/A | N/A | N/A | N/A | N/A |
| Milling Method | AT | WBM | AT | AT | AT | WBM |
| Milling Time (hr) | 13 | 12 | 4.5 | 4.5 | 4.5 | 16 |
| Dnsfctn* Method | PS | VS | VS | VS | PS | PS |
| Temp (° C.) | 1435 | 1550 | 1535 | 1550 | 1485 | 1550 |
| Time(hr) | 1.5 | 0.75 | 0.75 | 1.O | 1.5 | 1.5 |

These cermets were made using commercially available ingredients (as described in, for example, "World Directory and Handbook of HARDMETALS AND HARD MATERIALS" Sixth Edition). For example, Material 8, a WC-cermet of Table 1, was made from an about 10 kilogram (kg) batch of starting powders that comprised of about 89.9 wt. % WC (−80+400 mesh [particle size between about 38 μm and 180 μm] macrocrystalline tungsten carbide from Kennametal Inc. Fallon, Nev. [≠ this was also the starting WC for Materials 5 and 8–12 in Table 1]), about 4.5 wt. % commercially available extra fine cobalt powder, about 2.5 wt. % commercially available nickel powder (INCO Grade 255, INCO International, Canada), 2.5 wt. % commercially available iron powder (Carbonyl Iron Powder CN, BASF Corporation, Mount Olive, N.J.), and about 0.6 wt. % tungsten metal powder (particle size about 1 $\mu$m Kennametal Inc. Fallon, Nev.). This batch, to which was added about 2.1 wt. % paraffin wax and about 0.3 wt. % surfactant, was combined with about 4.5 liters of naphtha ("LACOLENE" petroleum distillates, Ashland Chemical Co., Columbus, Ohio) for wet ball milling for about 16 hours. The milled mixture was dried in a sigma blade drier, drymilled using a Fritzmill, and pelletized to produce a pressing powder having a Scott density of about $25\times10^6$ kg/m$^3$ (63.4 grams/inch$^3$). The pressing powder exhibited good flow characteristics during the formation into square plate green bodies (based on style SNG433 inserts) by pressing.

The green bodies were placed in an vacuum sintering furnace on dedicated furnace furniture for densification. The furnace and its contents, in a hydrogen atmosphere evacuated to about 0.9 kilopascal (kPa) [7 torr], were heated from about room temperature to about 180° C. (350° F.) in about 9/12 of an hour under vacuum and held for about 3/12 of an hour; heated to about 370° C. (700° F.) in about 9/12 of an hour and held for about 4/12 of an hour; heated to about 430° C. (800° F.) in about 5/12 of an hour and held for about 4/12 of an hour; heated to about 540° C. (1000° F.) in about 5/12 of an hour and held for about 2/12 of an hour; heated to about 590° C. (1100° F.) in about 4/12 of an hour; then, with the hydrogen gas shut off, heated to about 1,120° C. (2050° F.) in about 16/12 of an hour and held for about 4/12 of an hour under a vacuum ranging from about 15 micrometers to about 23 micrometers; heated to about 1,370° C. (2500° F.) in about 9/12 of an hour and held for about 4/12 of an hour while argon was introduced to about 1.995 kPa (15 torr); heated to about 1550° C. (2825° F.) in about 19/12 of an hour while argon was maintained at about 1.995 kPa (15 torr) and held for about 9/12 of an hour; and then the power to the furnace was turned off and the furnace and its contents were allowed to cool to about room temperature. As any person skilled in the art understands, Material 8 of Table 1 was made by known techniques. In this respect, the ability to use know techniques, and in particular vacuum sintering, is an advantage of the present invention and is contrary to the teachings of the art.

In a manner similar to Material 8, Materials 1–7 and 9–12 of Table 1 were formed, consolidated, and densified using substantially standard techniques. The densification of Materials 1–4, 6, 7, 11, and 12 was done using pressure sintering (also known as sinter-HIP) with the pressure of the atmosphere in the sintering furnace being raised to about 4 MPa (40 bar) for the last about 10 minutes at the temperature shown in Table 1. In addition, comparative prior art materials having only a Co-binders were made for Materials 2, 4–6, and 9–12 while a comparative prior art materials having a Co—Ni binder (Co:Ni=2:1) was made for Material 7.

The results of mechanical, physical, & microstructural properties for Materials 1–8 of Table 1 with the comparative prior art materials are summarized in Table 2. In particular, Table 2, summarized the density (g/cm$^3$), the magnetic saturation (0.1 $\mu$Tm$^3$/kg), the coercive force (Oe, measured substantially according to International Standard ISO 3326: Hardmetals-Determination of (the magnetization) coercivity the subject matter of which is herein incorporated by reference in its entirety in the present application), the hardness ($Hv_{30}$, measured substantially according to International Standard ISO 3878: Hardmetals-Vickers hardness test the subject matter of which is herein incorporated by reference in its entirety in the present application), the transverse rupture strength (MPa, measured substantially according to International Standard ISO 3327/Type B: Hardmetals-Determination of transverse rupture strength the subject matter of which is herein incorporated by reference in its entirety in the present application), and the porosity (measured substantially according to International Standard ISO 4505: Hardmetals-Metallographic determination of porosity and uncombined carbon the subject matter of which is herein incorporated by reference in its entirety in the present application).

TABLE 2

Mechanical, Physical, & Microstructural Properties for Materials 1–8 of Table 1 with Comparative Prior Art Materials

| | Density (g/cm$^3$) | Magnetic Saturation (0.1 $\mu$Tm$^3$kg) | Hc (Oe) | Hardness (Hv30) | TRS (MPa) | Porosity |
|---|---|---|---|---|---|---|
| Material 1 | 14.74 | 132 | 118 | 1480 | 3393 | <A02 |
| Material 2 | 14.05 | 267 | 129 | 1170 | 3660 | <A02 |
| Prior Art | | | | | | |
| Material 2 | 13.92 | 280 | 54 | 1090 | 3626 | <A02 |
| Material 3 | 13.24 | 406 | 26 | 820 | 3227 | <A02 |
| Material 4 | 13.01 | 493 | 81 | 840 | 3314 | <A02 |
| Prior Art | | | | | | |
| Material 4 | 12.88 | 474 | 16 | 700 | 3030 | <A02 |
| Material 5 | 14.44 | 173 | 54 | 960 | 1899 | A06 |
| Prior Art | | | | | | |
| Material 5 | 14.35 | 178 | 18 | 970 | 2288 | A04 |
| Material 6 | 14.01 | 111 | 150 | 1460 | 2785 | <A02 |
| Prior Art | | | | | | |
| Material 6 | 13.95 | 116 | 62 | 1420 | 2754 | <A02 |
| Material 7 | 6.66 | 113 | 116 | 1450 | 2500 | <A02 |
| Prior Art | | | | | | |
| Material 7 | 6.37 | 250 | 84 | 1430 | 2595 | <A02 |
| Material 8 | 14.39 | 184 | 22 | N/A | N/A | A00 |
| | | | | | | B00 |
| | | | | | | C00 |

An in-depth characterization of Materials 9–12 and comparative prior art materials was performed and is summarized in Tables 3, 4, 5, and 6. The data includes destiny (g/cm$^3$), magnetic saturation (Tm$^3$/kg,), coercive force (Hc, oersteds), Vickers Hardness (HV30), Rockwell Hardness (HRA), fracture toughness ($K_{Ic}$ megapascal meter square root [MPam$^{1/2}$], determined substantially according to ASTM Designation: C1161-90 Standard Test Method for Flexural Strength of Advanced Ceramics at Ambient Temperature, American Society for Testing and Materials, Philadelphia, Pa. the subject matter of which is herein incorporated by reference in its entirety in the present application), binder ratio (wt. % Co:wt. % Ni:wt. % Fe determined from the chemical analysis results), binder content (wt. % of cermet), transverse rupture strength (TRS, megapascal (MPa), determined substantially according to the method described by Schleinkofer et al. in Materials Science and Engineering, A194 (1995), 1–8 for Table 4 and by ISO 3327 for Tables 3, 5, and 6, the subject matter of which is herein incorporated by reference in its entirety in the present application), thermal conductivity (th.cond, calories/centimeter-second-degree-centigrade (cal/(cm·s·°C.), determined substantially by using a pulsed laser technique), Hot Vickers Hardness at 20° C., 200° C., 400° C., 600° C., and 800° C. (HV100/10, determined by indenting cermet samples a temperature using an about 100 gram load for about 10 seconds), and the chemical analysis of the binder (wt. %, determined using x-fluorescence [only Co, Ni, and Fe are assumed to be in the binder, Ta, Ti, Nb, and Cr are assumed to be carbides]).

TABLE 3

Comparison of Materials Properties - vacuum sintered at 1535° C.

| | Density g/cm$^2$ | Mag. Sat.* Tm$^3$/kg | Hc** Oe | HV30/15 *** | HRA**** | $K_{IC}$ MPa m$^{-1/2}$ | Ratio # wt % | Binder ## wt % | Porosity |
|---|---|---|---|---|---|---|---|---|---|
| prior art | 14.44 | 14.2 | 60.5 | 1018 | 86.4 | 16.2 ± 0.7 | 1:0:0.02 | 9.15 | A02–B00 |
| Material 9 | 14.35 | 14.7 | 22.0 | 973 | 85.8 | 16.1 ± 2.1 | 1.90:1:1.13 | 9.33 | A02–B00 |

| | TRS ### MPa | th. cond. #### cal/(cm sec. ° C.) | HV100/10 † 25° C. | HV100/10 † 200° C. | HV100/10 † 400° C. | HV100/10 † 600° C. | HV100/10 † 800° C. |
|---|---|---|---|---|---|---|---|
| prior art | 1949 | — | — | — | — | — | — |
| Material 9 | — | — | — | — | — | — | — |

| | Chemical Analysis in wt % | | | | | | |
|---|---|---|---|---|---|---|---|
| | Co | Ni | Fe | Ta | Ti | Nb | Cr |
| prior art | 8.94 | 0.02 | 0.19 | 0.16 | 0.1 | 0.05 | 0.03 |
| Material 9 | 4.40 | 2.32 | 2.61 | 0.18 | 0.1 | 0.05 | 0.03 |

*Magnetic Saturation
**Coercive Force
***Vickers Hardness
****Rockwell Hardness
Binder Ratio (Co:Ni:Fe)
total binder content in material
Transverse Rupture Strength (value determined by Weibull distribution)
Thermal Conductivity
† Hot Vickers Hardness

TABLE 4

Comparison of Materials Properties - vacuum sintered at 1550° C.

| | Density g/cm$^2$ | Mag. Sat.* Tm$^3$/kg | Hc** Oe | HV30/15 *** | HRA**** | $K_{IC}$ MPa m$^{-1/2}$ | Ratio # wt % | Binder ## wt % | Porosity |
|---|---|---|---|---|---|---|---|---|---|
| prior art | 14.40 | 14.2 | 62.7 | 1046 | 86.7 | — | 1:0:0.02 | 9.62 | A02–B00 |
| Material 9 | 14.34 | 14.85 | 23.7 | 987 | 86.0 | — | 1.98:1:1.15 | 9.59 | A02–B00 |

| | TRS ### MPa | th. cond. #### cal/(cm sec. ° C.) | HV100/10 † 25° C. | HV100/10 † 200° C. | HV100/10 † 400° C. | HV100/10 † 600° C. | HV100/10 † 800° C. |
|---|---|---|---|---|---|---|---|
| prior art | 1942 | — | 1144 | 884 | 656 | 447 | 252 |
| Material | 2089 | — | 1091 | 852 | 607 | 407 | 239 |

| | Chemical Analysis in wt % | | | | | | |
|---|---|---|---|---|---|---|---|
| | Co | Ni | Fe | Ta | Ti | Nb | Cr |
| prior art | 9.42 | 0.02 | 0.18 | 0.18 | 0.12 | — | — |
| Material 10 | 4.60 | 2.32 | 2.67 | 0.20 | 0.12 | — | — |

*Magnetic Saturation
**Coercive Force
***Vickers Hardness
****Rockwell Hardness
Binder Ratio (Co:Ni:Fe)
total binder content in material
Transverse Rupture Strength (value determined by Weibull distribution)
Thermal Conductivity
† Hot Vickers Hardness

TABLE 5

Comparison of Materials Properties - Pressure Sintered at 1485° C.

| | Density g/cm$^2$ | Mag. Sat.* Tm$^3$/kg | Hc** Oe | HV30 *** | HRA**** | $K_{IC}$ MPa m$^{-1/2}$ | Ratio # wt % | Binder ## wt % | Porosity |
|---|---|---|---|---|---|---|---|---|---|
| prior art | 14.46 | 14.75 | 57.5 | 1023 | 86.4 | 16.3 | 1:0:0.02 | 9.17 | A02–B00 |
| Material 9 | 14.36 | 14.65 | 21.5 | 975 | 85.8 | 16.7 | 1.98:1:1.12 | 8.98 | A02–B00 |

TABLE 5-continued

| Comparison of Materials Properties - Pressure Sintered at 1485° C. | | | | | | | |
|---|---|---|---|---|---|---|---|
| | TRS ### MPa | th. cond. #### cal/(cm sec. ° C.) | HV100/10 † 25° C. | HV100/10 † 200° C. | HV100/10 † 400° C. | HV100/10 † 600° C. | HV100/10 † 800° C. |
| prior art | 2397 | — | 1097 | 860 | 656 | 438 | 251 |
| Material 11 | 2467 | — | 1060 | 816 | 633 | 414 | 218 |

| | Chemical Analysis in wt % | | | | | | |
|---|---|---|---|---|---|---|---|
| | Co | Ni | Fe | Ta | Ti | Nb | Cr |
| prior art | 8.95 | 0.03 | 0.19 | 0.16 | 0.1 | 0.04 | 0.03 |
| Material | 4.34 | 2.19 | 2.45 | 0.17 | 0.1 | 0.05 | 0.03 |

*Magnetic Saturation
**Coercive Force
***Vickers Hardness
****Rockwell Hardness
Binder Ratio (Co:Ni:Fe)
total binder content in material
Transverse Rupture Strength (value determined by Weibull distribution)
Thermal Conductivity
† Hot Vickers Hardness

TABLE 6

| Comparison of Materials Properties - Pressure Sintered at 1550° C. | | | | | | | | | |
|---|---|---|---|---|---|---|---|---|---|
| | Density $g/cm^2$ | Mag. Sat.* $Tm^3/kg$ | Hc** Oe | HV30/15 *** | HRC**** | $K_{IC}$ MPa $m^{-1/2}$ | Ratio # wt % | Binder ## wt % | Porosity |
| prior art | 14.47 | 14.1 | 58.0 | 1030 | 86.5 | — | 1:0:0.01 | 9.56 | A02–B00 |
| Material 12 | 14.36 | 15 | 20.0 | 935 | 85.3 | — | 2:1:1.16 | 8.36 | A00–B00 |

| | TRS ### MPa | th. cond. #### cal/(cm sec. ° C.) | HV100/10 † 25° C. | HV100/10 † 200° C. | HV100/10 † 400° C. | HV100/10 † 600° C. | HV100/10 † 800° C. |
|---|---|---|---|---|---|---|---|
| prior art | 2070 | 0.245 | 1113 | 865 | 643 | 483 | 259 |
| Material 12 | 2085 | 0.227 | 1005 | 839 | 578 | 408 | 226 |

| | Chemical Analysis in wt % | | | | | | |
|---|---|---|---|---|---|---|---|
| | Co | Ni | Fe | Ta | Ti | Nb | Cr |
| prior art | 9.40 | 0.01 | 0.15 | 0.17 | 0.2 | 0.01 | 0.03 |
| Material 12 | 4.51 | 2.25 | 2.60 | 0.18 | 0.1 | 0.01 | 0.03 |

Figure 1:
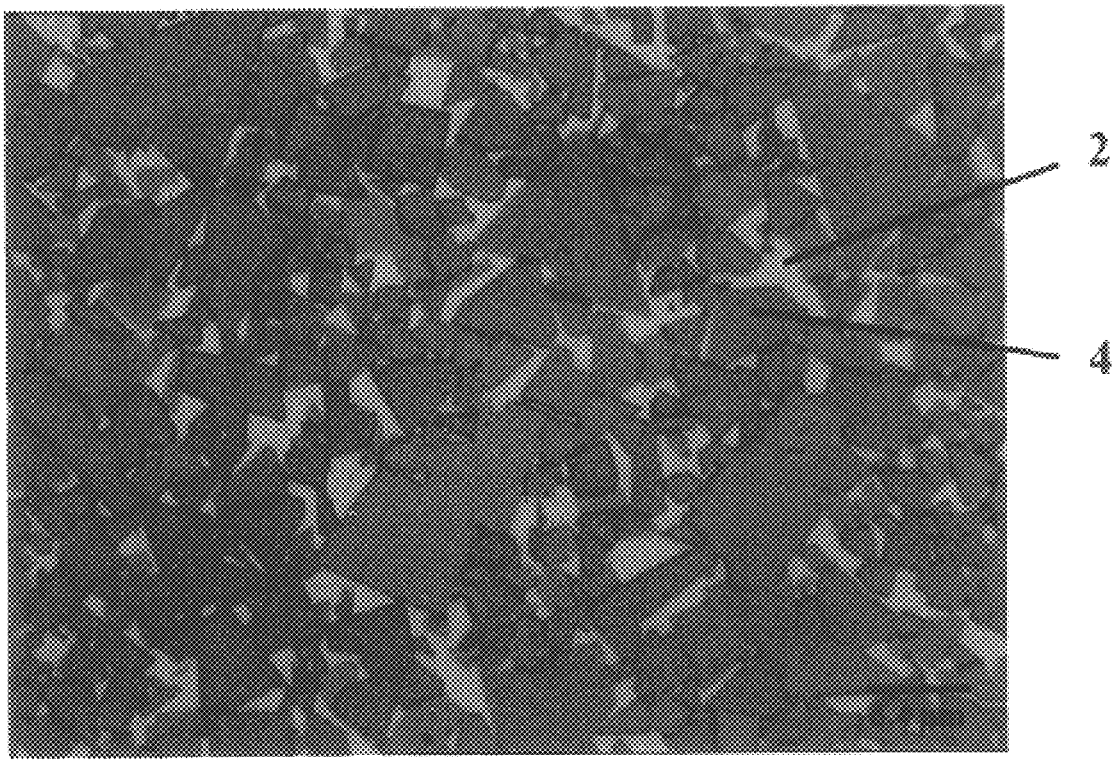
Figure 1A:
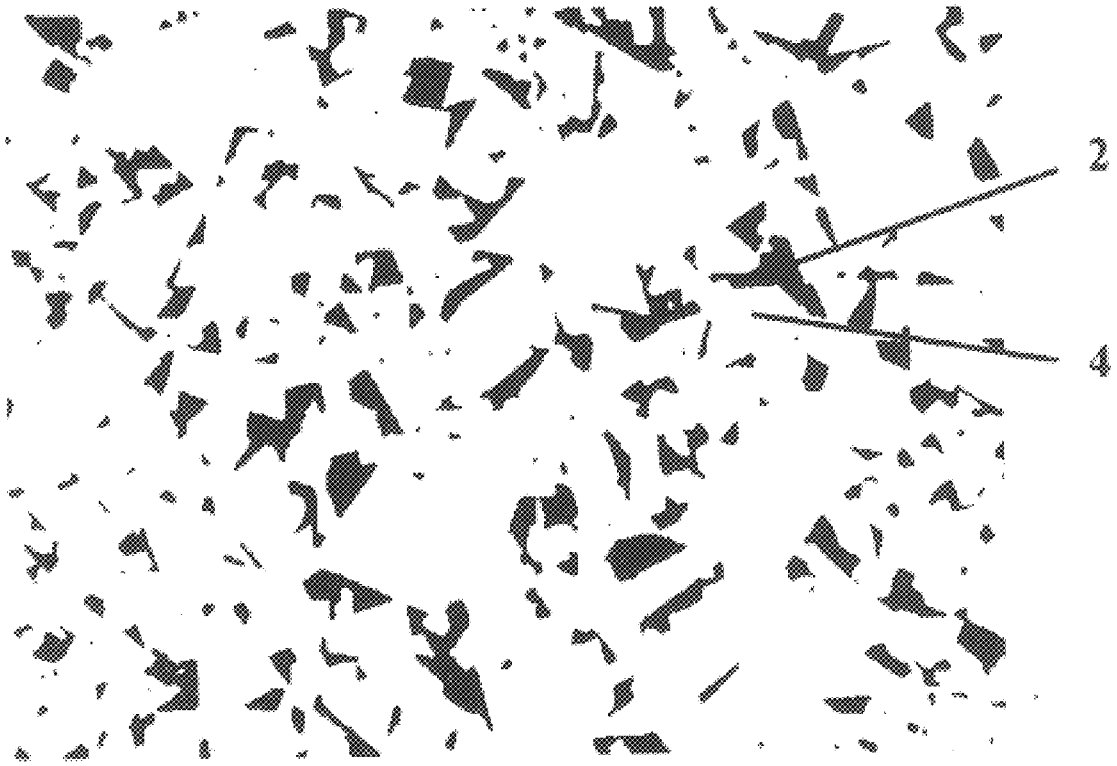
Figure 2:
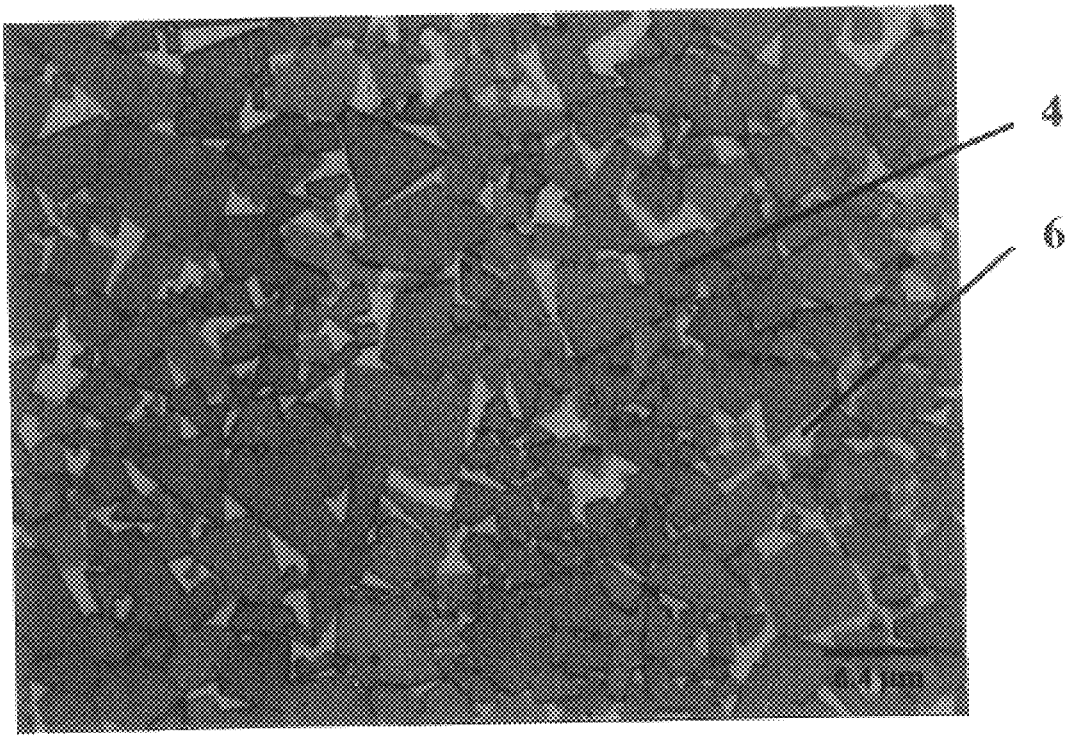
Figure 2A:
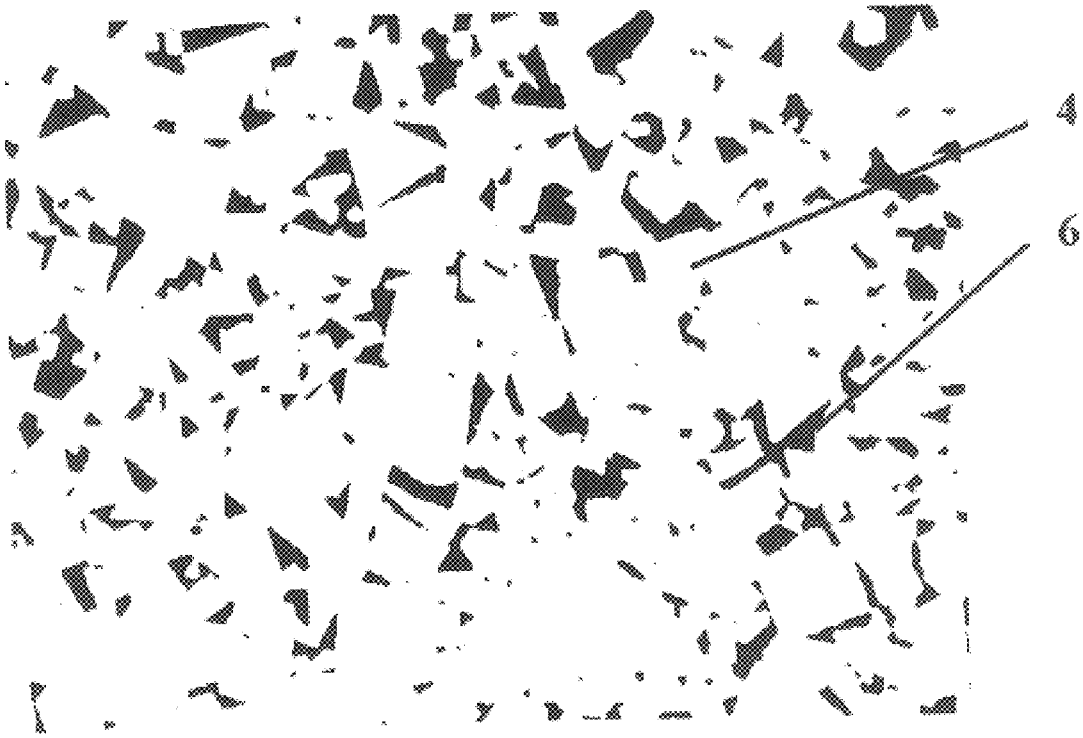

*Magnetic Saturation
**Coercive Force
***Vickers Hardness
****Rockwell Hardness
Binder Ratio (Co:Ni:Fe)
total binder content in material
Transverse Rupture Strength (value determined by Weibull distribution)
Thermal Conductivity
† Hot Vickers Hardness Briefly, the data demonstrates that WC-cermets having a Co—Ni—Fe-binder have properties that are at least comparable to and generally improved over those of comparative WC-cermets having a Co-binder. To better quantify the inventive WC-cermets having a Co—Ni—Fe-binder additional microstructural characterization, including optical microscopy, transmission electron microscopy, and scanning electron microscopy, was performed. FIG. 1 is an optical photomicrograph of the microstructure of a prior art WC-cermet having a tungsten carbide hard component 4 and a Co-binder 2 made by vacuum sintering at about 1550° C. (Material 10 Prior Art). FIG. 2 is an optical photomicrograph of the microstructure of a WC-cermet having a tungsten carbide hard component 4 and a Co—Ni—Fe-binder 6 also made by vacuum sintering at about 1550° C. (Material 10). The microstructures appear substantially the same. The volume percent of the binder (determined substantially by measuring the area percent of black) in the Material 10 Prior Art and Material 10 measured about 12.8 and 11.9 at about 1875×(6.4 μm), illustrated in FIGS. 1*a* and 2*a* respectively. Additional values measured about 13.4 and 14.0 at about 1200×(10 μm) respectively. The area percent of the binder for Material 9 Prior Art and Material 9 measured about 15.3 and 15.1 at about 1200×(10 μm) respectively. The area percent of the binder in the Material 11 Prior Art and Material 11 measured 14.6, 15.1 at about 1200×(10 μm) respectively. These data confirm that a WC-cermet having Co—Ni—Fe-binder has substantially the same distribution, on a volume percent basis, of hard component and binder as a prior art WC-cermet having a Co-binder when both were made from powder batches formulated on substantially the same weight percent basis of hard component and binder.

Figure 3:
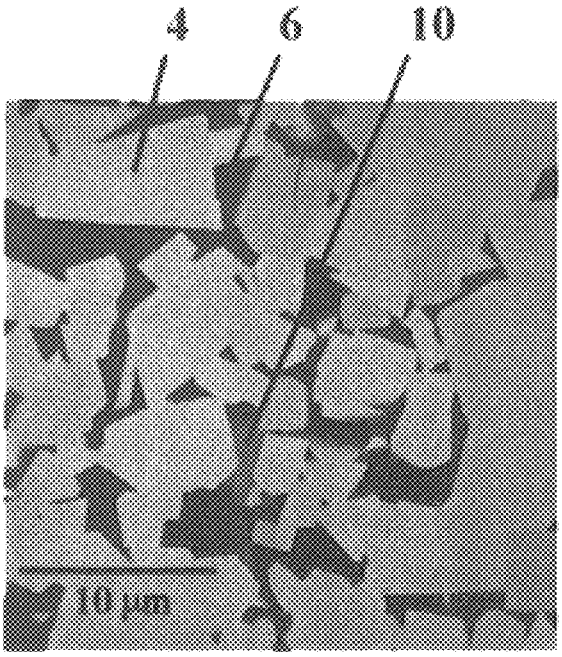
FIG. 3 shows a backscattered electron image (BEI) of the microstructure of a WC-cermet having a Co—Ni—Fe-binder of the present invention made by vacuum sintering at about 1535° C.
Figure 4:
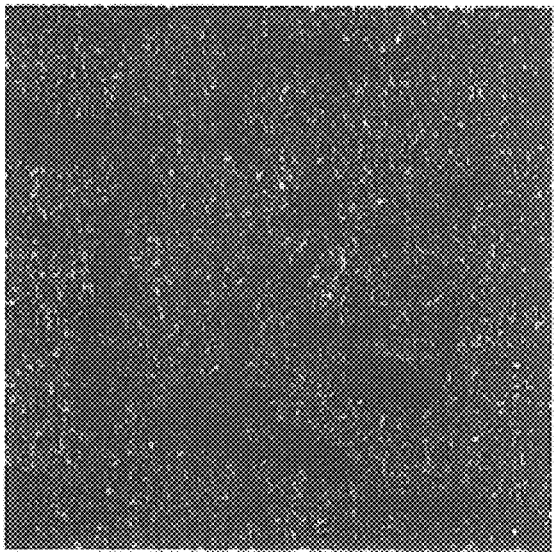
FIG. 4 shows an energy dispersive spectroscopy (EDS) elemental distribution map of tungsten (W) corresponding to the microstructure of the WC-cermet of FIG. 3.
Figure 5:
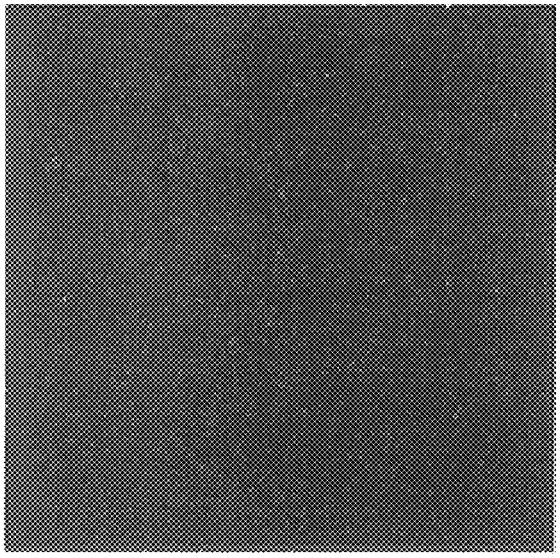
FIG. 5 shows an EDS elemental distribution map for carbon (C) corresponding to the microstructure of the WC-cermet of FIG. 3.
Figure 6:
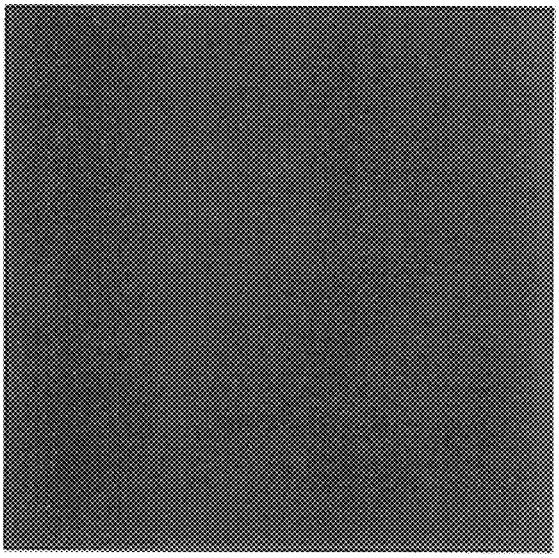
FIG. 6 shows an EDS elemental distribution map for oxygen (O) corresponding to the microstructure of the WC-cermet of FIG. 3.
Figure 7:
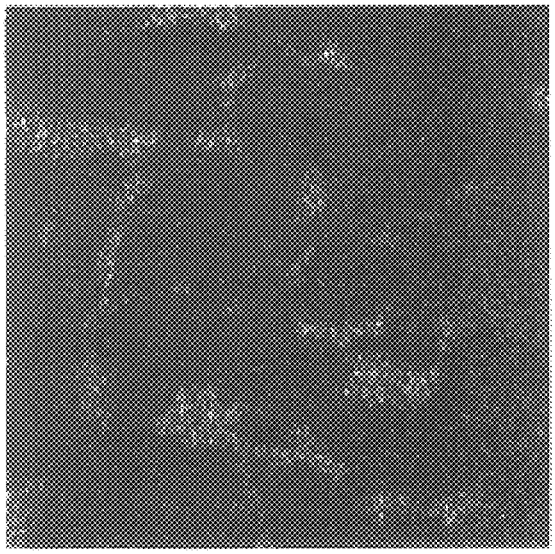
FIG. 7 shows an EDS elemental distribution map for cobalt (Co) corresponding to the microstructure of the WC-cermet of FIG. 3.
Figure 8:
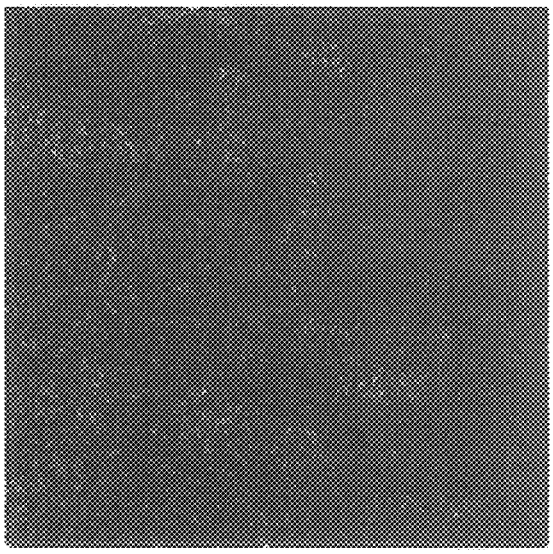
FIG. 8 shows an EDS elemental distribution map for nickel (Ni) corresponding to the microstructure of the WC-cermet of FIG. 3.
Figure 9:
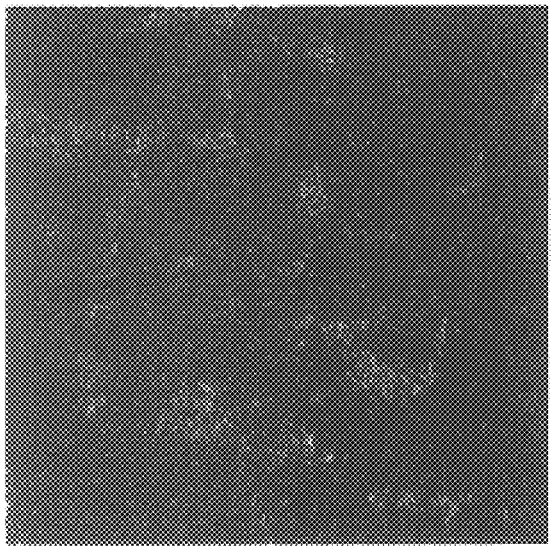
FIG. 9 shows an EDS elemental distribution map for iron (Fe) corresponding to the microstructure of the WC-cermet of FIG. 3.
Figure 10:
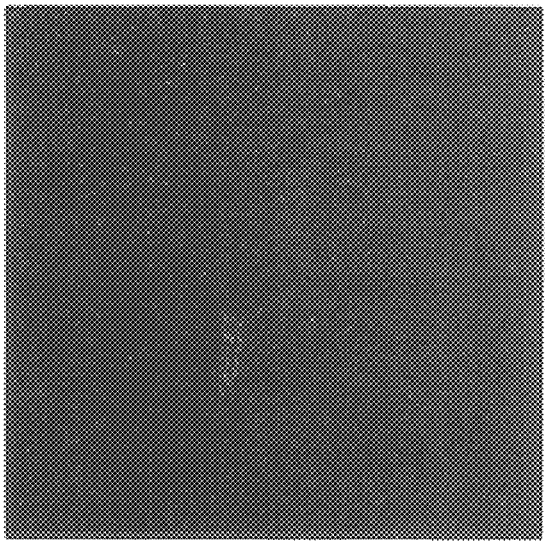
FIG. 10 shows an EDS elemental distribution map for titanium (Ti) corresponding to the microstructure of the WC-cermet of FIG. 3.

FIGS. 3 through 10 correlate of the distribution of elements (determined in a scanning electron microscope by energy dispersive spectroscopy using a JSM-6400 scanning electron microscope (Model No. ISM65-3, JEOL LTD, Tokyo, Japan) equipped with a $LaB_6$ cathode electron gun system and an energy dispersive x-ray system with a siliconlithium detector (Oxford Instruments Inc., Analytical System Division, Microanalysis Group, Bucks, England) in a sample of Material 9 to its microstructural features. FIG. 3 is a backscattered electron image (BEI) of the microstructure of Material 9 comprising a Co—Ni—Fe-binder 6, WC hard component 4, and a titanium carbide hard component 10. FIGS. 4 through 10 are the element distribution maps for tungsten (W), carbon (C), oxygen (O), cobalt (Co), nickel (Ni), iron (Fe), and titanium (Ti), respectively, corresponding to the microstructure of FIG. 3. The coincidence of Co, Ni, and Fe demonstrates their presence as the binder. The lack of coincidence of Co, Ni, and Fe with W demonstrates that Co—Ni—Fe-binder cements the tungsten carbide. The area in FIG. 10 showing a concentration of Ti in combination with the same area in the BEI of FIG. 3 suggests the presence of a titanium containing carbide.

Figure 11:
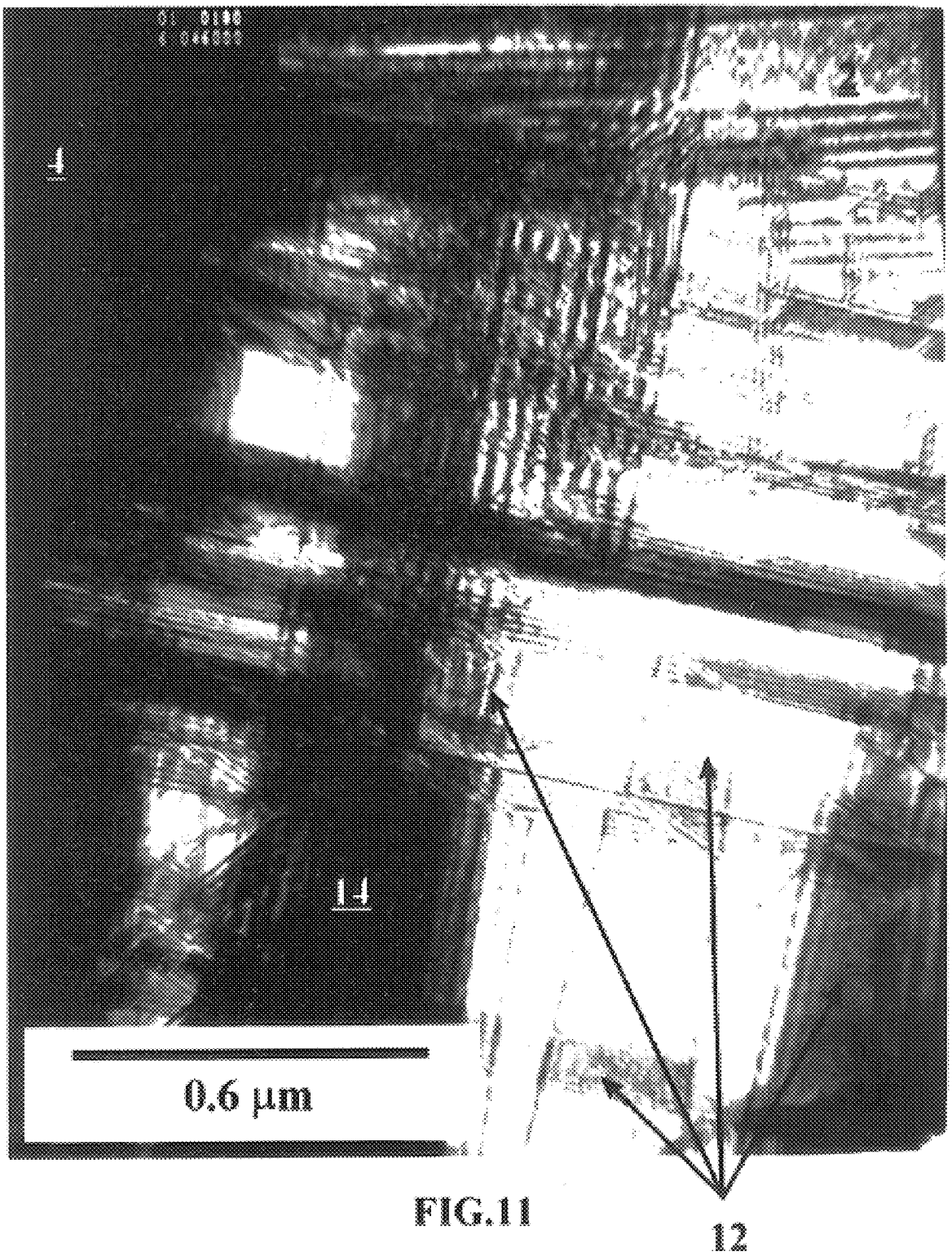
FIG. 11 shows a transmission electron microscopy (TEM) photomicrograph of a binder pool in a prior art WC-cermet having a Co-binder made by vacuum sintering at about 1535° C. illustrating the high stacking fault concentration in these prior art WC-cermets.
Figure 12:
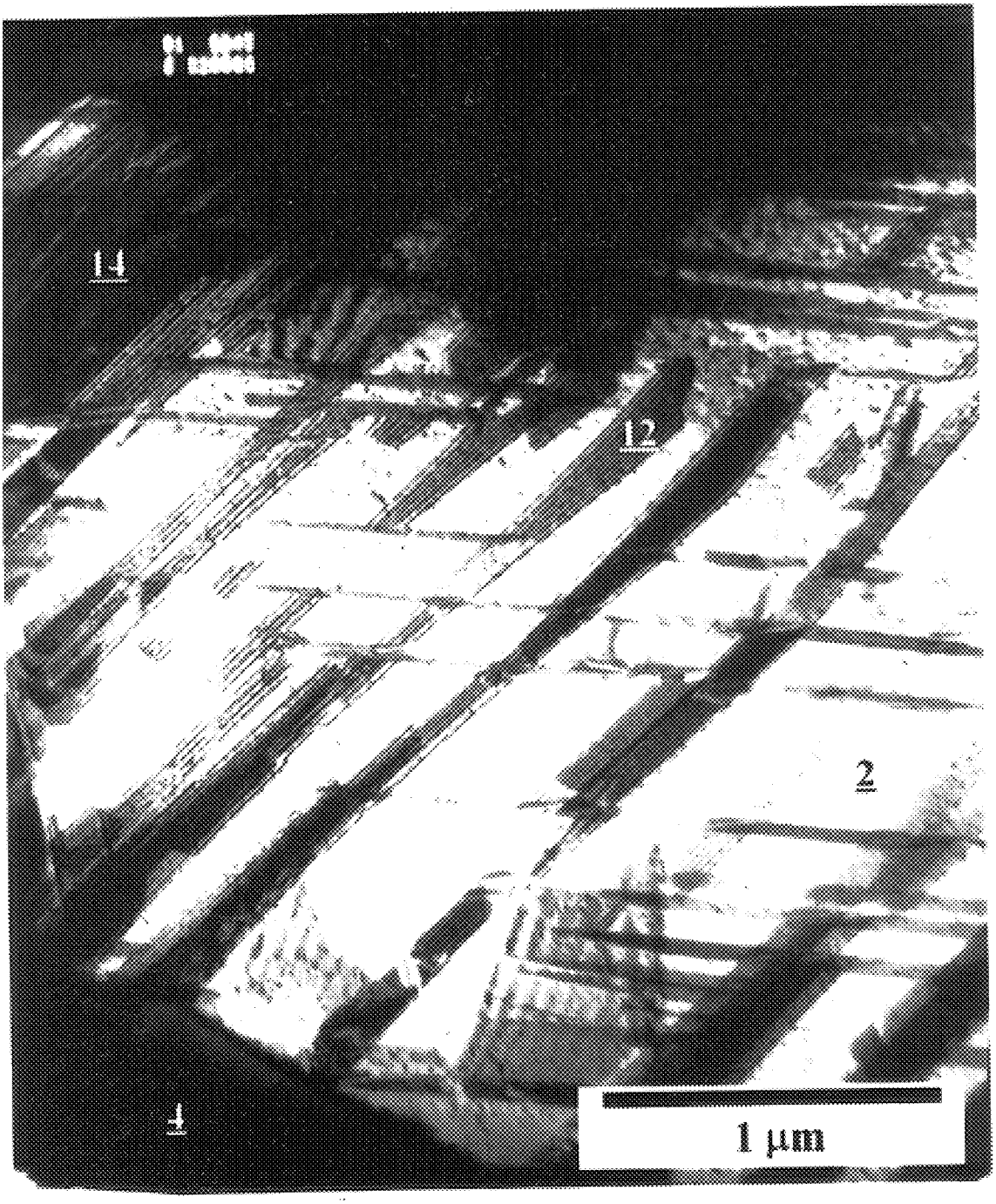
FIG. 12 shows a TEM photomicrograph of another binder pool in a prior art WC-cermet having a Co-binder made by vacuum sintering at about 1535° C. illustrating that the high stacking fault concentration is present throughout these prior art WC-cermets.

Transmission electron microscopy (TEM) studies of Material 11 Prior Art and Material 11 were conducted. Samples of both materials were prepared substantially according to the method described in "Fatigue of Hard Metals and Cermets under Cyclically Varying Stress" submitted by Uwe Schleinkofer as a Doctoral Thesis to the Technical Faculty of the University of Erlangen-Nuernberg, Germany (1995) the subject matter of which is herein incorporated by reference in its entirety in the present application. The studies were performed using a Phillips Electronics EM400T scanning transmission electron microscope (STEM) equipped an energy dispersive x-ray system with a siliconlithium detector (Oxford Instruments Inc., Analytical System Division, Microanalysis Group, Bucks, England). FIG. 11 shows a TEM image of the Co-binder 2 of Material 11 Prior Art. Planar stacking faults 12 are seem throughout the Co-binder 2 with high stacking fault concentration regions 14. Each stacking fault represents a thin layer of fcc→hcp transformed Co-binder. These high stacking fault concentration regions represent significantly fcc→hcp transformed Co-binder. One explanation for the planar stacking faults is that the Co-binder has a low stacking fault energy. Consequently the imposition of a stress and/or strain induces the transformation of an otherwise fcc structure to a hcp structure, hardening the Co-binder. FIG. 12 shows a TEM image of another area of the Co-binder 2 next to a tungsten carbide hard component 4 of Material 11 Prior Art. As with FIG. 11, planar stacking faults 12 are seem throughout the Co-binder 2 with high stacking fault concentration regions 14.

Figure 13:
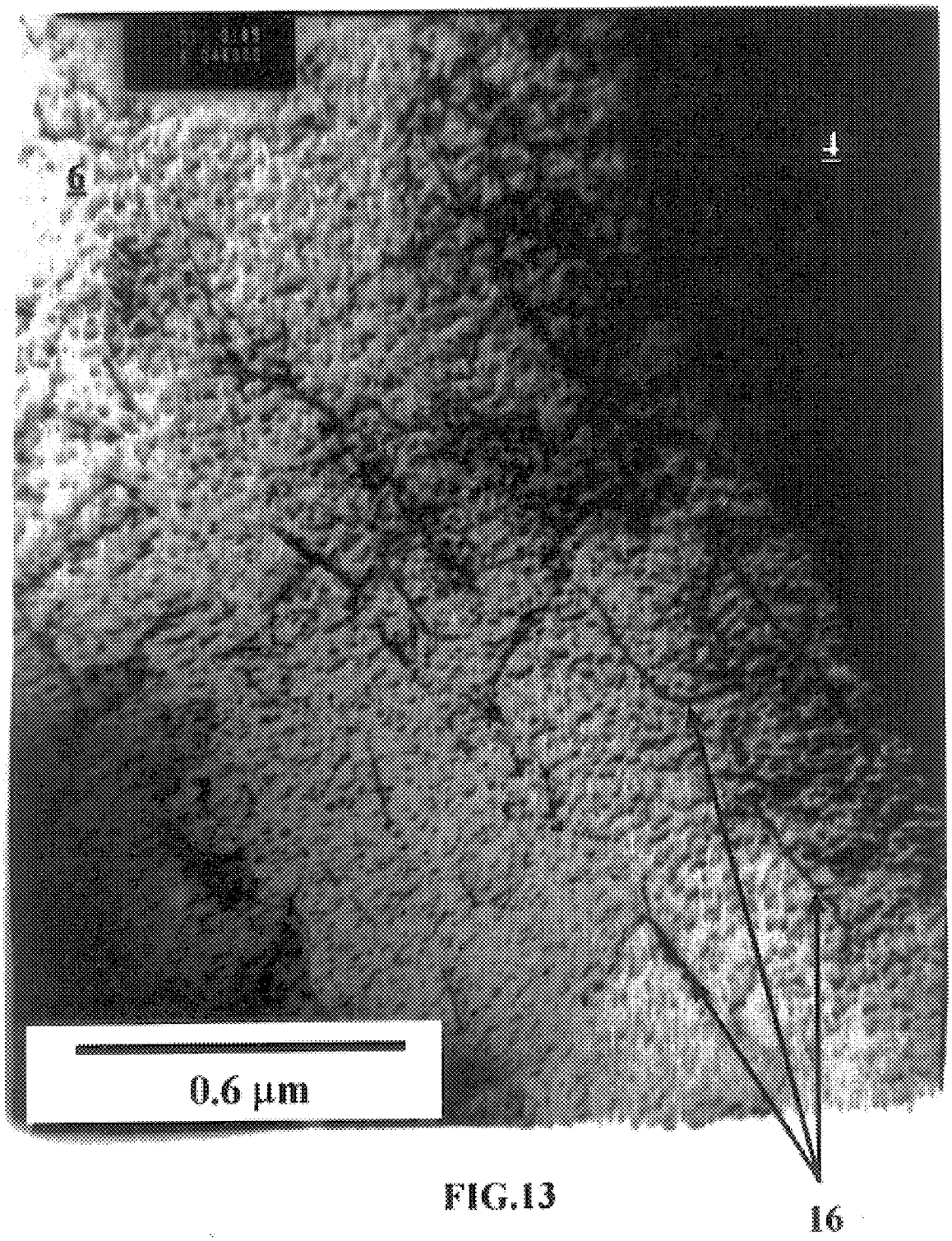
FIG. 13 shows a comparative TEM photomicrograph of a binder pool in a cermet of the present invention comprising a WC-cermet having a Co—Ni—Fe-binder made by vacuum sintering at about 1535° C. illustrating the absence of stacking faults.

In contrast, FIG. 13 shows a TEM image of the Co—Ni—Fe-binder 2 of Material 11. Besides a tungsten carbide hard component 4, FIG. 13 shows dislocations 16. Unlike the Material 11 Prior Art, applicants believe that the Co—Ni—Fe-binder of Material 11 has a high stacking fault energy that suppresses the formation of planar stacking faults. Further, applicants believe that the stacking fault energy is of a level that permits unconstrained dislocation movement. FIG. 14, 14*a*, and 14*b* show a comparative TEM photomicrograph, the results of selected area diffraction (SAD) along the [03 $\bar{1}$] zone axis, and the results of SAD along the [101] zone axis for the Co—Ni—Fe-binder of Material 11. The SAD results of FIGS. 14*a* and 14*b* are characteristic of a fcc structure and the absence of the hcp structure. Accordingly, the imposition of a stress and/or strain on the Co—Ni—Fe-binder generated nonplanar defects such as the dislocation 16. Such behavior indicates that there is greater plastic deformation in the Co—Ni—Fe-binder than in the Co-binder. The consequences of the limited plastic deformation in the Co-binder are dramatically shown in FIGS. 15 and 15*a*. These TEM images show a crack 22 that formed in the Co-binder 4, the crack orientation 20 and 20', and its coincidence with the stacking fault orientation 18 and 18'. In contrast, the benefits of the plasticity of the Co—Ni—Fe-binder are shown in FIGS. 16 and 16*a*. These TEM images show a single dislocation 38, dislocation slip marks 26 on the TEM thin section surface, and the high density of nonplanar, unconstrained-dislocations which is characteristic for high plastic deformation 24 of the Co—Ni—Fe-binder 6.

The transverse rupture strengths (TRS) measured for Material 9 Prior Art and Material 9 were analyzed using Weibull statistics. FIG. 17 presents the Weibull distribution plot of the TRS for Material 9 Prior Art having a Co-binder (represented by open circles "○") and Material 9 (represented by dots "●"). Material 9 Prior Art had a Weibull modulus of about 20.4 and a mean TRS (bending strength) of about 1949 MPa, both of which were determined from the linear least squares fit equation $\ln(\ln(1/(1-F)))=20.422\cdot\ln(\sigma/\mathrm{MPa})-154.7$ (represented in the figure by the - - - - - line). In this equation $F=(i-0.5)/Ni$, where i is the sample number and Ni is the total number of sample tested and $\sigma$ is the measure bending strength of material. Material 9 had a Weibull modulus of about 27.9 and a mean TRS (bending strength) of about 2050 MPa, both of which were determined from the linear least squares fit equation $\ln(\ln(1/(1-F)))=27.915\cdot\ln(\sigma/\mathrm{MPa})-212.87$ (represented in the figure by the - - - - - - line).

The TRS measured for Material 10 Prior Art and Material 10 were analyzed using Weibull statistics. FIG. 18 presents the Weibull distribution plot of the TRS Material 10 Prior Art having a Co-binder (represented by open circles "○") and Material 10 (represented by dots "●"). Material 10 Prior Art had a Weibull modulus of about 32.4 and a mean TRS (bending strength) of about 1942 MPa, both of which were determined from the linear least squares fit equation $\ln(\ln(1/(1\ F)))=32.4189\cdot\ln(\sigma/\mathrm{MPa})-245.46$ (represented in the figure by the - - - - - line). Material 10 had a Weibull modulus of about 9.9 and a mean TRS (bending strength) of about 2089 MPa, both of which were determined from the linear least squares fit equation $\ln(\ln(1/(1-F)))=9.9775\cdot\ln(\sigma/\mathrm{MPa})-75.509$ (represented in the figure by the - - - - - - line).

The TRS measured for Material 12 Prior Art and Material 12 were analyzed using Weibull statistics. FIG. 19 presents the Weibull distribution plot of the transverse rupture strengths (TRS) for Material 12 Prior Art having a Co-binder (represented by open circles "○") and Material 12 (represented by dots "●"). Material 12 Prior Art had a Weibull modulus of about 35.1 and a mean transverse rupture strength (bending strength) of about 2085 MPa, both of which were determined from the linear least squares fit equation $\ln(\ln(1/(1\ F)))=35.094\cdot\ln(\sigma/\mathrm{MPa})-268.2$ (represented in the figure by the - - - - - line). Material 12 had a Weibull modulus of about 17.2 and a mean transverse rupture strength (bending strength) of about 2110 MPa, both of which were determined from the linear least squares fit equation $\ln(\ln(1/(1-F)))=17.202\cdot\ln(\sigma/\mathrm{MPa})-131.67$ (represented in the figure by the - - - - - - line).

The fatigue performance of Material 10 Prior Art and Material 10 was evaluated at about room temperature, at about 700° C. in air (both determined substantially according to the method described in U. Schleinkofer, H. G. Sockel, P. Schlund, K. Görting, W. Heinrich, Mat. Sci. Eng. A194 (1995) 1; U. Schleinkofer, Doctorate Thesis, University of Erlangen-Nürnberg, Erlangen, 1995; U. Schleinkofer, H. G. Sockel, K. Görting, W. Heinrich, Mat. Sci. Eng. A209 (1996) 313; and U. Schleinkofer, H. G. Sockel, K. Görting, W. Heinrich, Int. J. of Refractory Metals & Hard Materials 15 (1997) 103 the subject matter of which is herein incorporated by reference in its entirety in the present application), and at about 700° C. in an argon atmosphere (determined substantially according to B. Roebuck, M. G. Gee, Mat. Sci. Eng. A209 (1996) 358 the subject matter of which is herein incorporated by reference in its entirety in the present application) and is shown in FIGS. 20, 21, and 22, respectively. In particular, FIG. 20 shows the stress amplitude ($\sigma_{max}$) as a function of cycles to failure at room temperature in air for Material 10 Prior Art (represented by open circles "○") and Material 10 (represented by dots "●"). FIG. 21 shows the stress amplitude ($\sigma_{max}$) as a function of cycles to failure tested at 700° C. in air for the prior art comparison for Material 10 Prior Art (represented by open circles "○") and Material 10 (represented by dots "●"). FIG. 22 shows low cycle fatigue performance data (stress amplitude [$\sigma_{max}$] as a function of cycles to failure tested) at 700° C. in an argon atmosphere for Material 10 Prior Art (represented by open circles "○") and Material 10 (represented by dots "●"). In all three tests, Material 10 had at least as long a fatigue life as Material 10 Prior Art and generally an improved life. As is seen in FIG. 20, Material 10 posses a superior fatigue life. In particular, three tests were stopped (designated "●→" in FIG. 20) at the defined infinate lifetime defined as 200,000 cycles. Further, FIG. 22 clearly demonstrates that Materials 10 has a superior fatigue life for the same stress level at elevated temperatures.

The patents and other documents identified herein are hereby incorporated by reference in their entirety in the present application.

Other embodiments of the invention will be apparent to those skilled in the art from a consideration of the specification or practice of the invention disclosed herein. For example, the cermets of the present invention may be used for materials manipulation or removal including, for example, mining, construction, agricultural, and metal removal applications. Some examples of agricultural applications include seed boots, inserts for agricultural tools, disc blades, stump cutters or grinders, furrowing tools, and earth working tools. Some examples of mining and construction applications include cutting or digging tools, earth augers, mineral or rock drills, construction equipment blades, rolling cutters, earth working tools, comminution machines, and excavation tools. Some examples of materials removal applications include drills, endmills, reamers, treading tools, materials cutting or milling inserts, materials cutting or milling inserts incorporating chip control features, and materials cutting or milling inserts comprising coating applied by any of chemical vapor deposition (CVD), pressure vapor deposition (PVD), conversion coating, etc. A specific example of the use of the cermets of the present invention includes the use of Material 3 of Table 1 as a screw head punch. Cermets used as screw head punches must possess high impact toughness. Material 3, a WC-cermet comprising about 22 wt. % Co—Ni—Fe-binder was tested against Material 4 Prior Art, a WC-cermet comprising about 27 wt. % Co-binder. Screw head punches made from Material 3 consistently out performed screw head punches made from Material 4 Prior Art—producing 60,000–90,000 screws verses 30,000–50,000 screws. Further, it was noted that Material 3 was more readily machined (e.g., chip form) than Material 4 Prior Art.

It is intended that the specification and examples be considered as illustrative only, with the true scope and spirit of the invention being indicated by the following claims.

What is claimed is:

1. A cermet comprising:

at least one hard component comprising a carbonitride and a Co—Ni—Fe-binder comprising about 40 wt. % to 90 wt. % cobalt, about 4 wt. % to 36 wt. % nickel, about 4 wt. % to 36 wt. % iron, and a Ni:Fe ratio of about 1.5:1 to 1:1.5.

2. The cermet of claim 1 wherein the Co—Ni—Fe-binder comprises a face centered cubic (fcc) structure that substantially maintains its fcc structure when subjected to plastic deformation and does not experience stress or strain induced transformations.

3. The cermet of claim 1 wherein the Co—Ni—Fe-binder comprises about 40 wt. % to 90 wt. % cobalt and a Ni:Fe ratio of about 1:1.

4. The cermet of claim 1 wherein the Co—Ni—Fe-binder comprises a cobalt:nickel:iron ratio comprises about 1.8:1:1.

5. The cermet of claim 1 wherein the Co—Ni—Fe-binder comprises about 0.3 wt. % to 25 wt. % of the cermet.

6. The cermet of claim 1 wherein the Co—Ni—Fe-binder comprises about 3 wt. % to 20 wt. % of the cermet.

7. The cermet of claim 1 wherein the at least one hard component comprises at least one carbonitride of at least one of titanium, zirconium, hafnium, vanadium, niobium, tantalum, chromium, molybdenum, and tungsten.

8. The cermet of claim 1 wherein the Co—Ni—Fe-binder comprises about 0.2 wt. % to 19 wt. % of the cermet.

9. The cermet of claim 1 wherein the Co—Ni—Fe-binder comprises about 5 wt. % to 16 wt. % of the cermet.

10. The cermet of claim 1 wherein the Co—Ni—Fe-binder comprises a face centered cubic (fcc) structure that substantially maintains its fcc structure when subjected to plastic deformation and does not experience stress and strain induced transformations.

11. A WC-cermet comprising:

tungsten carbide and a Co—Ni—Fe-binder comprising about 40 wt. % to 90 wt. % cobalt, about 4 wt. % to 36 wt. % nickel, about 4 wt. % to 36 wt. % iron, and a cobalt:nickel:iron ratio of about 1.8:1:1.

12. The WC-cermet of claim 11 wherein the Co—Ni—Fe-binder comprises about 0.2 wt. % to 19 wt. % of the cermet.

13. The WC-cermet of claim 11 wherein the Co—Ni—Fe-binder comprises about 5 wt. % to 15 wt. % of the cermet.

14. The WC-cermet of claim 11 further comprising at least one of carbides, nitrides, carbonitrides, their mixtures, and their solid solutions.

15. The WC-cermet of claim 1 further comprising at least one carbide of at least one of titanium, zirconium, hafnium, vanadium, niobium, tantalum, chromium, and molybdenum.

16. The WC-cermet of claim 11 further comprising at least one carbonitride of at least one of titanium, zirconium, hafnium, vanadium, niobium, tantalum, chromium, molybdenum, and tungsten.

17. A TiCN-cermet comprising:

titanium carbonitride and a Co—Ni—Fe-binder comprising about 40 wt. % to 90 wt. % cobalt, about 4 wt. % to 36 wt. % nickel, about 4 wt. % to 36 wt. % iron, and a Ni:Fe ratio from about 1.5:1 to 1:1.5.

18. The TiCN-cermet of claim 17 wherein the Co—Ni—Fe-binder comprises about 40 wt. % to 90 wt. % cobalt and a Ni:Fe ratio of about 1:1.

19. The TiCN-cermet of claim 17 wherein the Co—Ni—Fe-binder comprises a cobalt:nickel:iron ratio comprises about 1.8:1:1.

20. The TiCN-cermet of claim 17 further comprising at least one of carbides, nitrides, carbonitrides, their mixtures, and their solid solutions.

21. The TiCN-cermet of claim 17 further comprising at least one carbide of at least one of titanium, zirconium, hafnium, vanadium, niobium, tantalum, chromium, molybdenum, and tungsten.

22. The TiCN-cermet of claim 17 further comprising at least one carbonitride of at least one of zirconium, hafnium, vanadium, niobium, tantalum, chromium, molybdenum, and tungsten.

23. A method of making a cermet comprising the steps of:

providing at least one hard component comprising at least one carbonitride;

combining a binder comprising about 40 wt. % to 90 wt. % cobalt, about 4 wt. % to 36 wt. % nickel, about 4 wt. % to 36 wt. % iron, and a Ni:Fe ratio of about 1.5:1 to 1:1.5 with the at least one hard component to form a powder blend;

densifying the powder blend for a time at a temperature to produce the cermet.

24. The method of claim 23 wherein the binder comprises a mixture of cobalt, nickel, and iron.

25. The method of claim 23 wherein the binder comprises an alloy of cobalt, nickel, and iron.

26. The method of claim 23 wherein the at least one hard component further comprises at least one of carbides, nitrides, and mixtures and solid solutions of carbides, nitrides, and carbonitrides.

27. The method of claim 23 wherein the at least one hard component further comprises at least one carbide of at least one of titanium, zirconium, hafnium, vanadium, niobium, tantalum, chromium, molybdenum, and tungsten.

28. The method of claim 23 wherein the at least one hard component comprising the carbonitride comprises at least one carbonitride of at least one of titanium, zirconium, hafnium, vanadium, niobium, tantalum, chromium, molybdenum, and tungsten.

29. The method of claim 23 wherein the at least one hard further component comprises a carbide.

30. The method of claim 23 wherein the at least one hard component further comprises a tungsten carbide.

31. The method of claim 23 wherein the densification comprises at least one of vacuum sintering and pressure sintering.

32. A cermet comprising:

at least one hard component and a Co—Ni—Fe-binder comprising about 40 wt. % to 90 wt. % cobalt, about 4 wt. % to 36 wt. % nickel, about 4 wt. % to 36 wt. % iron, and a cobalt:nickel:iron ratio comprises about 1.8:1:1.

33. The cermet of claim 32 wherein the Co—Ni—Fe-binder comprises a face centered cubic (fcc) structure that substantially maintains its fcc structure when subjected to plastic deformation and does not experience stress or strain induced transformations.

34. The cermet of claim 32 wherein the Co—Ni—Fe-binder comprises about 0.3 wt. % to 25 wt. % of the cermet.

35. The cermet of claim 32 wherein Co—Ni—Fe-binder comprises about 5 wt. % to 15 wt. % of the cermet.

36. The cermet of claim 32 wherein the at least one hard component comprises at least one of carbides, nitrides, carbonitrides, their mixtures, and their solid solutions.

37. The cermet of claim 32 wherein the at least one hard component comprises at least one carbide of at least one of titanium, zirconium, hafnium, vanadium, niobium, tantalum, chromium, molybdenum, and tungsten.

38. The cermet of claim 32 wherein the at least one hard component comprises at least one carbonitride of at least one of titanium, zirconium, hafnium, vanadium, niobium, tantalum, chromium, molybdenum, and tungsten.

39. The cermet of claim 32 wherein the at least one hard component comprises a carbide.

40. The cermet of claim 32 wherein the Co—Ni—Fe-binder comprises a face centered cubic (fcc) structure that substantially maintains its fcc structure when subjected to plastic deformation and does not experience stress and strain induced transformations.

41. A WC-cermet comprising:

tungsten carbide;

at least one carbonitride of at least one of titanium, zirconium, hafnium, vanadium, niobium, tantalum, chromium, molybdenum, and tungsten; and a Co—Ni—Fe-binder comprising about 40 wt. % to 90 wt. % cobalt, about 4 wt. % to 36 wt. % nickel, about 4 wt. % to 36 wt. % iron, and a Ni:Fe ratio from about 1.5:1 to 1:1.5.

42. The WC-cermet of claim 41 wherein the Co—Ni—Fe-binder comprises about 40 wt. % to 90 wt. % cobalt and a Ni:Fe ratio of about 1:1.

43. The WC-cermet of claim 41 wherein the Co—Ni—Fe-binder comprises about a cobalt:nickel:iron ratio comprises about 1.8:1:1.

44. The WC-cermet of claim 41 further comprising at least one of carbides, nitrides, carbonitrides, their mixtures, and their solid solutions.

45. The WC-cermet of claim 41 further comprising at least one carbide of at least one of titanium, zirconium, hafnium, vanadium, niobium, tantalum, chromium, and molybdenum.

46. The WC-cermet of claim 41 wherein Co—Ni—Fe-binder comprises about 5 wt. % to 15 wt. % of the cermet.

* * * * *